US006108621A

United States Patent [19]

Nishiguchi et al.

[11] Patent Number: 6,108,621

[45] Date of Patent: Aug. 22, 2000

[54] SPEECH ANALYSIS METHOD AND SPEECH ENCODING METHOD AND APPARATUS

[75] Inventors: Masayuki Nishiguchi; Jun Matsumoto, both of Kanagawa; Kazuyuki Iijima, Saitama; Akira Inoue, Tokyo, all of Japan

[73] Assignee: Sony Corporation, Tokyo, Japan

[21] Appl. No.: 08/946,373

[22] Filed: Oct. 7, 1997

[30] Foreign Application Priority Data

Oct. 18, 1996 [JP] Japan ..... 8-276501

[51] Int. Cl.[7] ..... G10L 11/04

[52] U.S. Cl. ..... 704/207

[58] Field of Search ..... 704/200, 201, 704/207

[56] References Cited

U.S. PATENT DOCUMENTS

| | | | |
|---|---|---|---|
| 3,681,530 | 8/1972 | Manley et al. | 179/1 |
| 4,214,125 | 7/1980 | Mozer et al. | 179/1 |
| 4,538,234 | 8/1985 | Honda et al. | 704/229 |
| 4,821,324 | 4/1989 | Ozawa et al. | 381/31 |
| 4,850,022 | 7/1989 | Honda et al. | 381/36 |
| 5,115,240 | 5/1992 | Fujiwara et al. | 341/51 |
| 5,127,053 | 6/1992 | Koch | 381/31 |
| 5,473,727 | 12/1995 | Nishiguchi et al. . | |
| 5,577,159 | 11/1996 | Shoham | 395/2.15 |
| 5,596,675 | 1/1997 | Ishii et al. | 395/2.2 |
| 5,630,012 | 5/1997 | Nishiguchi et al. | 395/2.17 |
| 5,664,052 | 9/1997 | Nishiguchi et al. | 704/214 |
| 5,715,365 | 2/1998 | Griffin et al. | 395/2.23 |
| 5,717,819 | 2/1998 | Emeott et al. | 395/2.3 |
| 5,732,392 | 3/1998 | Mizuno et al. | 704/233 |
| 5,737,718 | 4/1998 | Tsutsui | 704/205 |
| 5,749,065 | 5/1998 | Nishiguchi et al. | 704/219 |
| 5,752,222 | 5/1998 | Nishiguchi et al. | 704/201 |
| 5,873,059 | 2/1999 | Iijima et al. | 704/207 |

OTHER PUBLICATIONS

G. Yang et al.,Multiband Code–Excited Linear Prediction for Speech Coding, Signal Processing: European Journal Devoted to the Methods and Applications of Signal Processing, vol. 31, No. 2, pp. 215–227 (Mar. 1993).

H. Hassanein et al., Frequency Selective Harmonic Coding at 2400 bps, Proceedings of the Midwest Symposium on Circuits and Systems, vol. 2, pp. 1436–1439 (Aug. 1994).

*Primary Examiner*—Krista Zele
*Assistant Examiner*—Michael N. Opsasnick
*Attorney, Agent, or Firm*—Jay H. Maioli

[57] ABSTRACT

A speech analysis method and a speech encoding method and apparatus in which, even if the harmonics of the speech spectrum are offset from integer multiples of the fundamental wave, the amplitudes of the harmonics can be evaluated correctly for producing a playback output of high clarity. To this end, the frequency spectrum of the input speech is split on the frequency axis into plural bands in each of which pitch search and evaluation of amplitudes of the harmonics are carried out simultaneously using an optimum pitch derived from the spectral shape. Using the structure of an harmonics as the spectral shape, and based on the rough pitch previously detected by an open-loop rough pitch search, a high-precision pitch search comprised of a first pitch search for the frequency spectrum in its entirety and a second pitch search of higher precision than the first pitch search is carried out. The second pitch search is performed independently for each of the high range side and the low range side of the frequency spectrum.

14 Claims, 15 Drawing Sheets

| | 2Kbps | | 6Kbps | |
|---|---|---|---|---|
| V/UV DECISION OUTPUT | 1bit / 20msec | | 1bit / 20msec | |
| LSP QUANTIZATION INDEX | 32bits / 40msec | | 48bits / 40msec | |
| FOR VOICED SOUND (V) | PITCH DATA | 8bits / 20msec | PITCH DATA | 8bits / 20msec |
| | INDEX 15bits / 20msec | | INDEX 87bits / 20msec | |
| | SHAPE (FIRST STAGE) | 5+5bits / 20msec | SHAPE (FIRST STAGE) | 5+5bits / 20msec |
| | GAIN | 5bits / 20msec | GAIN | 5bits / 20msec |
| | | | INDEX (SECOND STAGE) | 72bits / 20msec |
| FOR UNVOICED SOUND (UV) | INDEX 11bits / 10msec | | INDEX 23bits / 5msec | |
| | SHAPE (FIRST STAGE) | 7bits / 10msec | SHAPE (FIRST STAGE) | 9bits / 5msec |
| | GAIN | 4bits / 10msec | GAIN | 6bits / 5msec |
| | | | SHAPE (SECOND STAGE) | 5bits / 5msec |
| | | | GAIN | 3bits / 5msec |
| FOR VOICED SOUND | 40bits / 20msec | | 120bits / 20msec | |
| FOR UNVOICED SOUND | 39bits / 20msec | | 117bits / 20msec | |

FIG.15

SPEECH ANALYSIS METHOD AND SPEECH ENCODING METHOD AND APPARATUS

BACKGROUND OF THE INVENTION

1. Field of the Invention

This invention relates to a speech analysis method in which an input speech signal is divided in terms of blocks or frames as encoding units, the pitch corresponding to the fundamental period of the encoding-unit-based speech signals is detected and in which the speech signals are analyzed on the basis of the detected pitch from one encoding unit to another. The invention also relates to a speech encoding method and apparatus employing this speech analysis method.

2. Description of the Related Art

There have hitherto been known a variety of encoding methods for encoding an audio signal (inclusive of speech and acoustic signals) for signal compression by exploiting statistic properties of the signals in the time domain and in the frequency domain and psychoacoustic characteristics of the human being. The encoding method may roughly be classified into time-domain encoding, frequency domain encoding and analysis/synthesis encoding.

Examples of the high-efficiency encoding of speech signals include sinusoidal analytic encoding, such as harmonic encoding or multi-band excitation (MBE) encoding, sub-band coding (SBC), linear predictive coding (LPC), discrete cosine transform (DCT), modified DCT (MDCT) and fast Fourier transform (FFT).

In conventional encoding of harmonics for LPC residuals, MBE, STC or harmonics encoding, pitch search for a rough pitch is carried out in an open loop followed by a high-precision pitch search for a finer pitch. During this pitch search for a finer pitch, high-precision pitch search (search for fractional pitch with a sample value less than an integer) and amplitude evaluation of the waveform in the frequency range are carried out simultaneously. This high-precision pitch search is carried out for minimizing the distortion of the synthesized waveform of the frequency spectrum in its entirety, that is the synthesized spectrum, and the original spectrum, such as the spectrum of the LPC residuals.

However, in a frequency spectrum of the speech of a human being, a spectral component is not necessarily present at frequencies corresponding to integer number multiples of the fundamental wave. On the contrary, these spectral components may be delicately shifted along the frequency axis. In these cases, there are occasions wherein the amplitude evaluation of the frequency spectrum cannot be achieved correctly even if the high-precision pitch search is carried out using a sole fundamental frequency or pitch over the entire frequency spectrum of the speech signal.

SUMMARY OF THE INVENTION

It is therefore an object of the present invention to provide a speech analysis method for correctly evaluating the amplitudes of harmonics of the frequency spectrum of the speech present offset from the integer multiples of the fundamental wave, and a method and an apparatus for producing a playback output of high clarity by application of the above speech analysis method.

In the speech analysis method according to the present invention, an input speech signal is divided on the time axis in terms of a pre-set encoding unit, a pitch equivalent to a basic period of the speech signal thus divided into the encoding units is detected and the speech signal is analyzed based on the detected pitch from one encoding unit to another. The method includes the steps of splitting the frequency spectrum of a signal corresponding to the input speech signal into a plurality of bands on the frequency axis and simultaneously carrying out pitch search and evaluation of the amplitudes of harmonics using the pitch derived from the spectral shape from one band to another.

With the speech analysis method according to the present invention, the amplitudes of harmonics offset from integer multiples of the fundamental wave can be evaluated correctly.

In the encoding method and apparatus of the present invention, the input speech signal is split on the time axis into pre-set plural encoding units, the pitch corresponding to the basic period of the speech signals in each of the encoding units is detected and the speech signal is encoded based on the detected pitch from one encoding unit to another. The frequency spectrum of a signal corresponding to the input speech signal is split into a plurality of bands on the frequency axis and pitch search and evaluation of the amplitudes of harmonics are carried out simultaneously using the pitch derived from the spectral shape from one band to another.

With the speech analysis method according to the present invention, the amplitudes of harmonics offset from integer multiples of the fundamental wave can be evaluated correctly thus producing a playback output of high clarity free of a buzzing sound feel or distortion.

Specifically, the frequency spectrum of the input speech signal is split on the frequency axis into plural bands in each of which pitch search and evaluation of the amplitudes of the harmonics are carried out simultaneously. The spectral shape is of the structure of harmonics. The first pitch search based on the rough pitch previously detected by the open-loop rough pitch search is carried out for the frequency spectrum in its entirety at the same time as the second pitch search higher in precision than the first pitch search is carried out independently for each of the high frequency range side and the low frequency range side of the frequency spectrum. The amplitudes of harmonics of the speech spectrum offset from the integer multiples of the fundamental wave can be evaluated correctly for producing a high clarity playback output.

BRIEF DESCRIPTION OF THE DRAWINGS

FIG. 15 shows the bit rates of output data.

DESCRIPTION OF THE PREFERRED EMBODIMENTS

Figure 1:
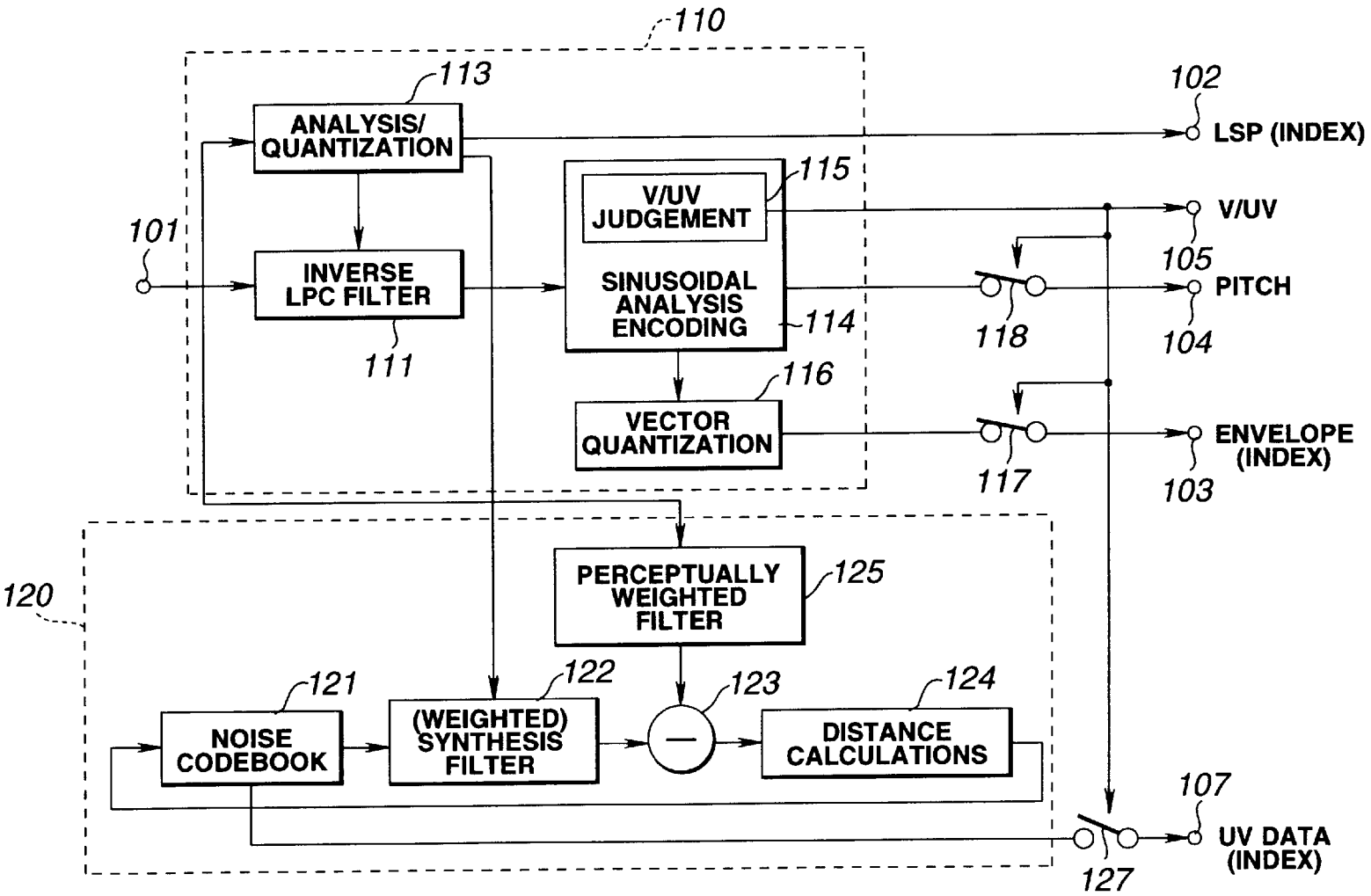
FIG. 1 is a block diagram showing the basic structure of a speech encoding device adapted for carrying out the speech encoding method embodying the present invention.

Referring to the drawings, preferred embodiments of the present invention will be explained in detail.

FIG. 1 shows a basic structure of a speech encoding apparatus (speech encoder) implementing the speech analysis method and the speech encoding method embodying the present invention.

The basic concept underlying the speech signal encoder of FIG. 1 is that the encoder has a first encoding unit 110 for finding short-term prediction residuals, such as linear prediction encoding (LPC) residuals, of the input speech signal, in order to effect sinusoidal analysis encoding, such as harmonic coding, and a second encoding unit 120 for encoding the input speech signal by waveform encoding having phase reproducibility, and that the first encoding unit 110 and the second encoding unit 120 are used for encoding the voiced (V) portion of the input signal and for encoding the unvoiced (UV) portion of the input signal, respectively.

The first encoding unit 110 employs a constitution of encoding, for example, the LPC residuals, with sinusoidal analytic encoding, such as harmonic encoding or multi-band excitation (MBE) encoding. The second encoding unit 120 employs a constitution of carrying out code excited linear prediction (CELP) using vector quantization by closed loop search of an optimum vector by closed loop search and also using, for example, an analysis by synthesis method.

In an embodiment shown in FIG. 1, the speech signal supplied to an input terminal 101 is sent to an LPC inverted filter 111 and an LPC analysis and quantization unit 113 of the first encoding unit 110. The LPC coefficients or the so-called α-parameters, obtained by an LPC analysis quantization unit 113, are sent to the LPC inverted filter 111 of the first encoding unit 110. From the LPC inverted filter 111 are taken out linear prediction residuals (LPC residuals) of the input speech signal. From the LPC analysis quantization unit 113, a quantized output of linear spectrum pairs (LSPs) are taken out and sent to an output terminal 102, as later explained. The LPC residuals from the LPC inverted filter 111 are sent to a sinusoidal analytic encoding unit 114. The sinusoidal analytic encoding unit 114 performs pitch detection and calculations of the amplitude of the spectral envelope as well as V/UV discrimination by a V/UV discrimination unit 115. The spectra envelope amplitude data from the sinusoidal analytic encoding unit 114 is sent to a vector quantization unit 116. The codebook index from the vector quantization unit 116, as a vector-quantized output of the spectral envelope, is sent via a switch 117 to an output terminal 103, while an output of the sinusoidal analytic encoding unit 114 is sent via a switch 118 to an output terminal 104. A V/UV discrimination output of the V/uv discrimination unit 115 is sent to an output terminal 105 and, as a control signal, to the switches 117, 118. If the input speech signal is a voiced (V) sound, the index and the pitch are selected and taken out at the output terminals 103, 104, respectively.

The second encoding unit 120 of FIG. 1 has, in the present embodiment, a code excited linear prediction coding (CELP coding) configuration, and vector-quantizes the time-domain waveform using a closed loop search employing an analysis by synthesis method in which an output of a noise codebook 121 is synthesized by a weighted synthesis filter, the resulting weighted speech is sent to a subtractor 123, an error between the weighted speech and the speech signal supplied to the input terminal 101 and thence through a perceptually weighting filter 125 is taken out, the error thus found is sent to a distance calculation circuit 124 to effect distance calculations and a vector minimizing the error is searched by the noise codebook 121. This CELP encoding is used for encoding the unvoiced speech portion, as explained previously. The codebook index, as the UV data from the noise codebook 121, is taken out at an output terminal 107 via a switch 127 which is turned on when the result of the V/UV discrimination is unvoiced (UV).

Figure 2:
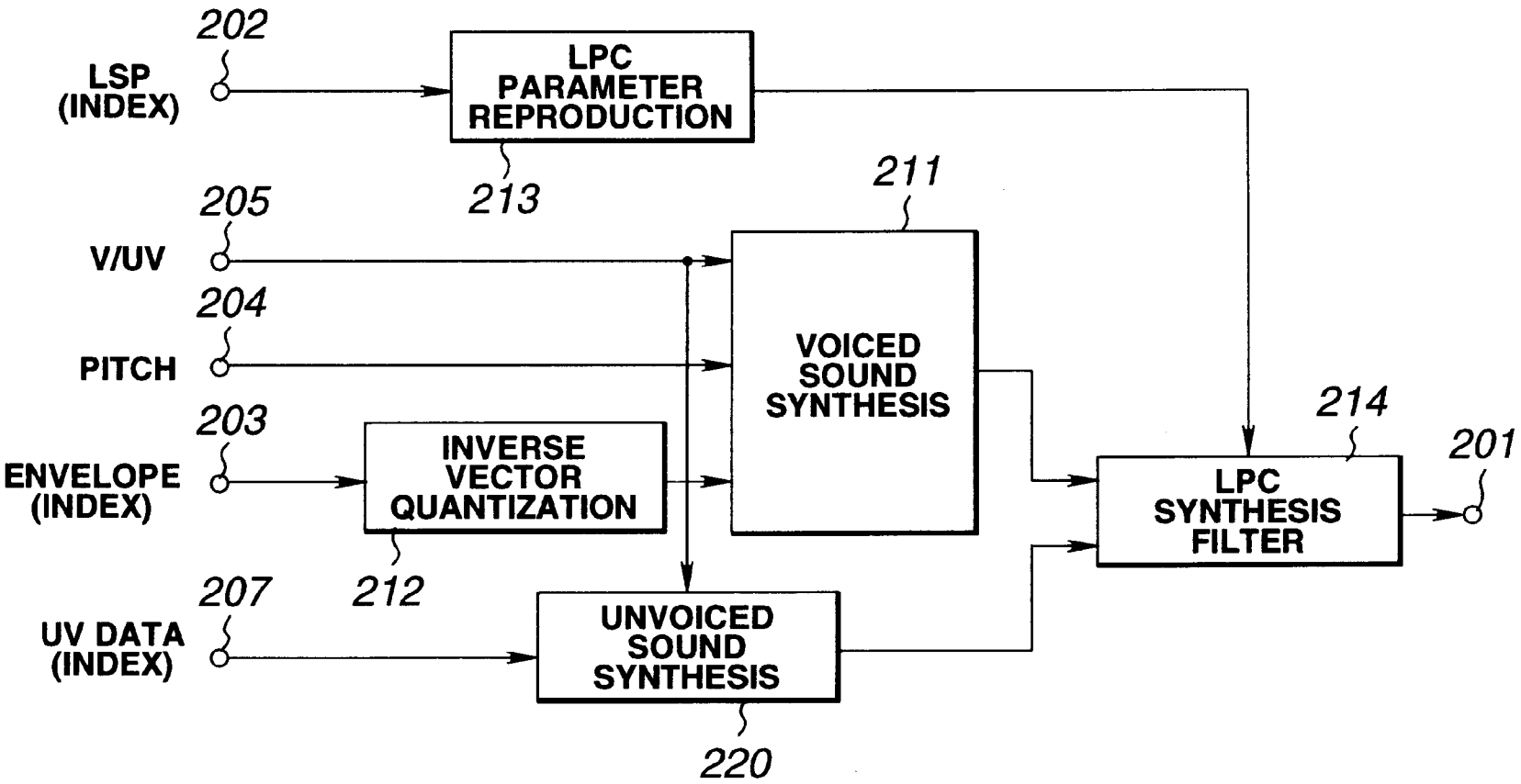
FIG. 2 is a block diagram showing the basic structure of a speech decoding device adapted for carrying out the speech decoding method embodying the present invention.

FIG. 2 is a block diagram showing the basic structure of a speech signal decoder, as a counterpart device of the speech signal encoder of FIG. 1, for carrying out the speech decoding method according to the present invention.

Referring to FIG. 2, a codebook index as a quantization output of the linear spectral pairs (LSPs) from the output terminal 102 of FIG. 1 is supplied to an input terminal 202. Outputs of the output terminals 103, 104 and 105 of FIG. 1, that is the pitch, V/UV discrimination output and the index data, as envelope quantization output data, are supplied to input terminals 203 to 205, respectively. The index data for the unvoiced data supplied from the output terminal 107 of FIG. 1 is supplied to an input terminal 207.

The index as the envelope quantization output of the input terminal 203 is sent to an inverse vector quantization unit 212 for inverse vector quantization to find a spectral envelope of the LPC residues which is sent to a voiced speech synthesizer 211. The voiced speech synthesizer 211 synthesizes the linear prediction encoding (LPC) residuals of the voiced speech portion by sinusoidal synthesis. The synthesizer 211 is fed also with the pitch and the V/UV discrimination output from the input terminals 204, 205. The LPC residuals of the voiced speech from the voiced speech synthesis unit 211 are sent to an LPC synthesis filter 214. The index data of the UV data from the input terminal 207 is sent to an unvoiced speech synthesis unit 220 where reference is had to the noise codebook for taking out the LPC residuals of the unvoiced portion. These LPC residuals are also sent to the LPC synthesis filter 214. In the LPC synthesis filter 214, the LPC residuals of the voiced portion and the LPC residuals of the unvoiced portion are independently processed by LPC synthesis. Alternatively, the LPC residuals of the voided portion and the LPC residuals of the unvoiced portion summed together may be processed with LPC synthesis. The LSP index data from the input terminal 202 is sent to the LPC parameter reproducing unit 213 where α-parameters of the LPC are taken out and sent to the LPC synthesis filter 214. The speech signals synthesized by the LPC synthesis filter 214 are taken out at an output terminal 201.

Figure 3:
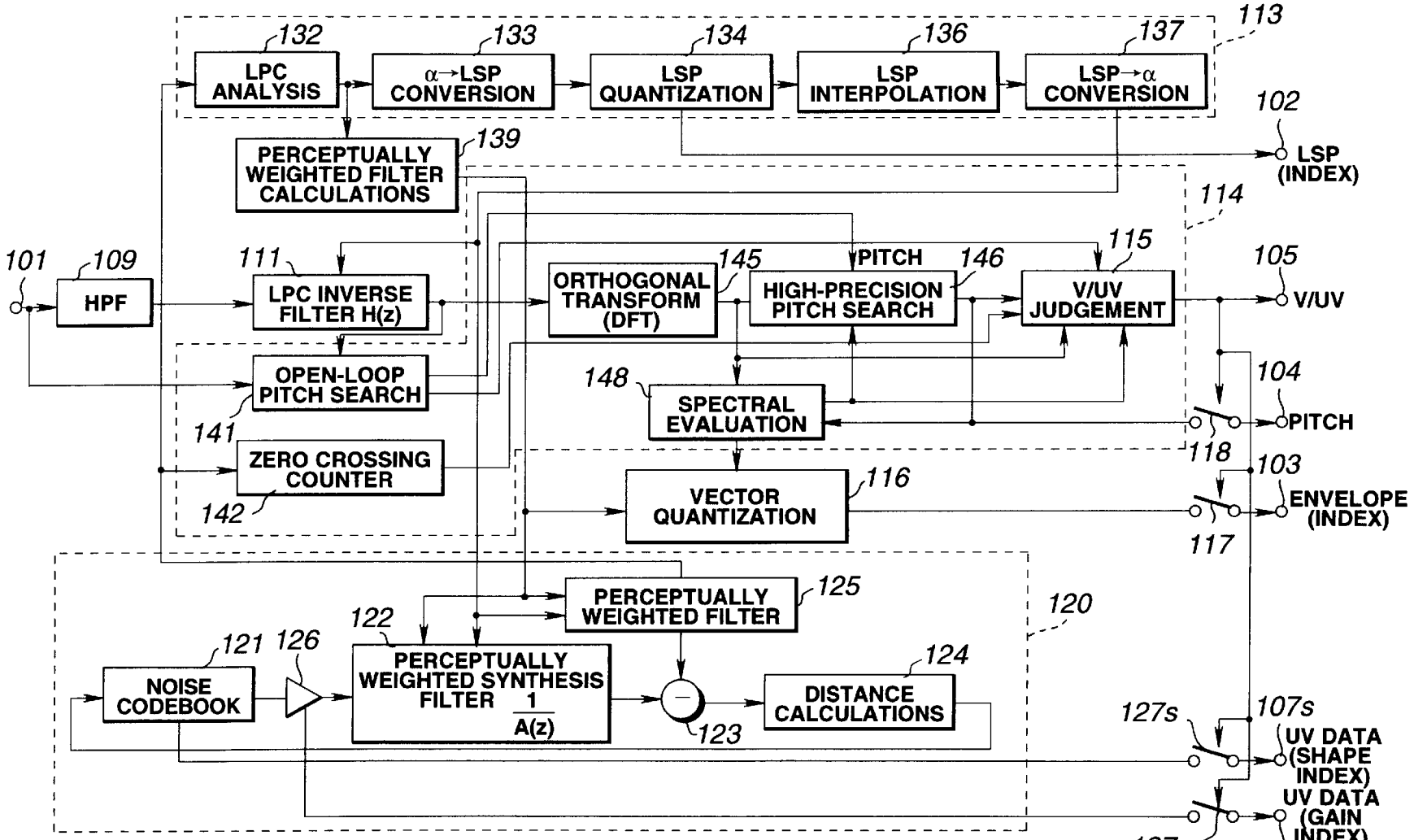
FIG. 3 is a block diagram showing a more specified structure of a speech encoding apparatus embodying the present invention.

Referring to FIG. 3, a more detailed structure of a speech signal encoder shown in FIG. 1 is now explained. In FIG. 3, the parts or components similar to those shown in FIG. 1 are denoted by the same reference numerals.

In the speech signal encoder shown in FIG. 3, the speech signals supplied to the input terminal 101 are filtered by a high-pass filter HPF 109 for removing signals of an unneeded range and thence supplied to an LPC analysis circuit 132 of the LPC analysis/quantization unit 113 and to the inverted LPC filter 111.

The LPC analysis circuit 132 of the LPC analysis/quantization unit 113 applies a Hamming window, with a length of the input signal waveform on the order of 256 samples of the input signal waveform with a sampling frequency fs=8 kHz, as a block, and finds a linear prediction coefficient, that is a so-called α-parameter, by the autocorrelation method. The framing interval as a data outputting unit is set to approximately 160 samples. If the sampling frequency fs is 8 kHz, for example, a one-frame interval is 20 msec or 160 samples.

The α-parameter from the LPC analysis circuit 132 is sent to an α-LSP conversion circuit 133 for conversion into line spectrum pair (LSP) parameters. This converts the αparameter, as found by direct type filter coefficient, into for example, ten, that is five pairs of the LSP parameters. This conversion is carried out by, for example, the Newton-Rhapson method. The reason the α-parameters are converted into the LSP parameters is that the LSP parameter is superior in interpolation characteristics to the α-parameters.

The LSP parameters from the α-LSP conversion circuit 133 are matrix-or vector quantized by the LSP quantizer 134. It is possible to take a frame-to-frame difference prior to vector quantization, or to collect plural frames in order to perform matrix quantization. In the present case, two frames, each 20 msec long, of the LSP parameters, calculated every 20 msec, are handled together and processed with matrix quantization and vector quantization. For quantizing LSP parameters in the LSP range, α- or k-parameters may be quantized directly. The quantized output of the quantizer 134, that is the index data of the LSP quantization, are taken out at a terminal 102, while the quantized LSP vector is sent directly to an LSP interpolation circuit 136.

The LSP interpolation circuit 136 interpolates the LSP vectors, quantized every 20 msec or 40 msec, in order to provide an octatuple rate (oversampling). That is, the LSP vector is updated every 2.5 msec. The reason is that, if the residual waveform is processed with the analysis/synthesis by the harmonic encoding/decoding method, the envelope of the synthetic waveform presents an extremely sooth waveform, so that, if the LPC coefficients are changed abruptly every 20 msec, a foreign noise is likely to be produced. That is, if the LPC coefficient is changed gradually every 2.5 msec, such foreign noise may be prevented from occurrence.

For inverted filtering of the input speech using the interpolated LSP vectors produced every 2.5 msec, the quantized LSP parameters are converted by an LSP-to-αconversion circuit 137 into α-parameters, which are filter coefficients of e.g., ten-order direct type filter. An output of the LSP-to-α conversion circuit 137 is sent to the LPC inverted filter circuit 111 which then performs inverse filtering for producing a smooth output using an α-parameter updated every 2.5 msec. An output of the inverse LPC filter 111 is sent to an orthogonal transform circuit 145, such as a DCT circuit, of the sinusoidal analysis encoding unit 114, such as a harmonic encoding circuit.

The α-parameter from the LPC analysis circuit 132 of the LPC analysis/quantization unit 113 is sent to a perceptual weighting filter calculating circuit 139 where data for perceptual weighting is found. These weighting data are sent to a perceptual weighting vector quantizer 116, perceptual weighting filter 125 and the perceptually weighted synthesis filter 122 of the second encoding unit 120.

The sinusoidal analysis encoding unit 114 of the harmonic encoding circuit analyzes the output of the inverted LPC filter 111 by a method of harmonic encoding. That is, pitch detection, calculations of the amplitudes Am of the respective harmonics and voiced (V)/ unvoiced (UV) discrimination, are carried out and the numbers of the amplitudes Am or the envelopes of the respective harmonics, varied with the pitch, are made constant by dimensional conversion.

In an illustrative example of the sinusoidal analysis encoding unit 114 shown in FIG. 3, commonplace harmonic encoding is used. In particular, in multi-band excitation (MBE) encoding, it is assumed in modeling that voiced portions and unvoiced portions are present in each frequency area or band at the same time point (in the same block or frame). In other harmonic encoding techniques, it is uniquely judged whether the speech in one block or in one frame is voiced or unvoiced. In the following description, a given frame is judged to be UV if the totality of the bands are UV, insofar as the MBE encoding is concerned. Specified examples of the technique of the analysis synthesis method for MBE as described above may be found in JP Patent Application No. 4-91442 filed in the name of the Assignee of the present Application.

The open-loop pitch search unit 141 and the zero-crossing counter 142 of the sinusoidal analysis encoding unit 114 of FIG. 3 is fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the inverted LPC filter 111.

The open loop pitch search unit 141 takes the LPC residuals of the input signals to perform relatively rough pitch search by open loop search. The extracted rough pitch data is sent to a fine pitch search unit 146 where fine pitch search by closed loop search as later explained is executed. The pitch data used is the so-called pitch lag, that is the pitch period represented as the number of samples on the time axis. A decision output from the voiced/unvoiced (V/UV) decision unit 115 may also be used as a parameter for open loop pitch search. It is noted that only the pitch information extracted from the portion of the speech signal judged to be voiced (V) is used for the above open-loop pitch search.

The orthogonal transform circuit 145 performs orthogonal transform, such as 256-point discrete Fourier transform (DFT), for converting the LPC residuals on the time axis into spectral amplitude data on the frequency axis. An output of the orthogonal transform circuit 145 is sent to the fine pitch search unit 146 and a spectral evaluation unit 148 configured for evaluating the spectral amplitude or envelope.

The fine pitch search unit 146 is fed with relatively rough pitch data extracted by the open loop pitch search unit 141 and with frequency-domain data obtained by DFT by the orthogonal transform unit 145. Based on the rough pitch $P_0$, the fine pitch search unit 146 performs two-step high-precision pitch search made up of an integer search and a fractional search.

The integer search is a pitch extraction method in which a set of several samples are swung about the rough pitch as center to select the pitch. The fractional search is a pitch detection method in which a fractional number of samples, that is a number of samples represented by a fractional number, is swung about the rough pitch as center to select the pitch.

As techniques for the above-mentioned integer search and fractional search, a so-called analysis-by-synthesis method is used for selecting the pitch so that the synthesized power spectrum will be closest to the power spectrum of the original speech.

In the spectral evaluation unit 148, the amplitude of each harmonics and the spectral envelope as the sum of the harmonics are evaluated based on the spectral amplitude and the pitch as the orthogonal transform output of the LPC residuals, and sent to the fine pitch search unit 146, V/UV discrimination unit 115 and to the perceptually weighted vector quantization unit 116.

The V/UV discrimination unit 115 discriminates V/UV of a frame based on an output of the orthogonal transform circuit 145, an optimum pitch from the fine pitch search unit 146, spectral amplitude data from the spectral evaluation unit 148, maximum value of the normalized autocorrelation r(p) from the open loop pitch search unit 141 and the zero-crossing count value from the zero-crossing counter 142. In addition, the boundary position of the band-based V/UV discrimination for the MBE may also be used as a condition for V/UV discrimination. A discrimination output of the V/UV discrimination unit 115 is taken out at an output terminal 105.

An output unit of the spectrum evaluation unit 148 or an input unit of the vector quantization unit 116 is provided with a number of data conversion unit (a unit performing a sort of sampling rate conversion). The number of data conversion unit is used for setting the amplitude data |Am| of an envelope to a constant value in consideration that the number of bands split on the frequency axis and the number of data differ with the pitch. That is, if the effective band is up to 3400 kHz, the effective band can be split into 8 to 63 bands depending on the pitch. The number of $m_{MX}+1$ of the amplitude data |Am|, obtained from band to band, is changed in a range from 8 to 63. Thus the data number conversion unit converts the amplitude data of the variable number $m_{MX}+1$ to a pre-set number M of data, such as 44 data.

The amplitude data or envelope data of the pre-set number M, such as 44, from the data number conversion unit, provided at an output unit of the spectral evaluation unit 148 or at an input unit of the vector quantization unit 116, are handled together in terms of a pre-set number of data, such as 44 data, as a unit, by the vector quantization unit 116, by way of performing weighted vector quantization. This weight is supplied by an output of the perceptual weighting filter calculation circuit 139. The index of the envelope from the vector quantizer 116 is taken out by a switch 117 at an output terminal 103. Prior to weighted vector quantization, it is advisable to take inter-frame difference using a suitable leakage coefficient for a vector made up of a pre-set number of data.

The second encoding unit 120 is explained. The second encoding unit 120 has a so-called CELP encoding structure and is used in particular for encoding the unvoiced portion of the input speech signal. In the CELP encoding structure for the unvoiced portion of the input speech signal, a noise output, corresponding to the LPC residuals of the unvoiced sound, as a representative output value of the noise codebook, or a so-called stochastic codebook 121, is sent via a gain control circuit 126 to a perceptually weighted synthesis filter 122. The weighted synthesis filter 122 LPC-synthesizes the input noise by LPC synthesis and sends the produced weighted unvoiced signal to the subtractor 123. The subtractor 123 is fed with a signal supplied from the input terminal 101 via a high-pass filter (HPF) 109 and which is perceptually weighted by a perceptual weighting filter 125. The subtractor finds the difference or error between this signal and the signal from the synthesis filter 122. Meanwhile, a zero input response of the perceptually weighted synthesis filter is previously subtracted from an output of the perceptual weighting filter output 125. This error is fed to a distance calculation circuit 124 for calculating the distance. A representative vector value which will minimize the error is searched in the noise codebook 121. The above is the summary of the vector quantization of the time-domain waveform employing the closed-loop search by the analysis by synthesis method.

As data for the unvoiced (UV) portion from the second encoder 120 employing the CELP coding structure, the shape index of the codebook from the noise codebook 121 and the gain index of the codebook from the gain circuit 126 are taken out. The shape index, which is the UV data from the noise codebook 121, is sent to an output terminal 107*s* via a switch 127*s*, while the gain index, which is the UV data of the gain circuit 126, is sent to an output terminal 107*g* via a switch 127 *g*.

These switches 127*s*, 127*g* and the switches 117, 118 are turned on and off depending on the results of V/UV decision from the V/UV discrimination unit 115. Specifically, the switches 117, 118 are turned on, if the results of V/UV discrimination of the speech signal of the frame currently transmitted indicates voiced (V), while the switches 127*s*, 127*g* are turned on if the speech signal of the frame currently transmitted is unvoiced (UV).

Figure 4:
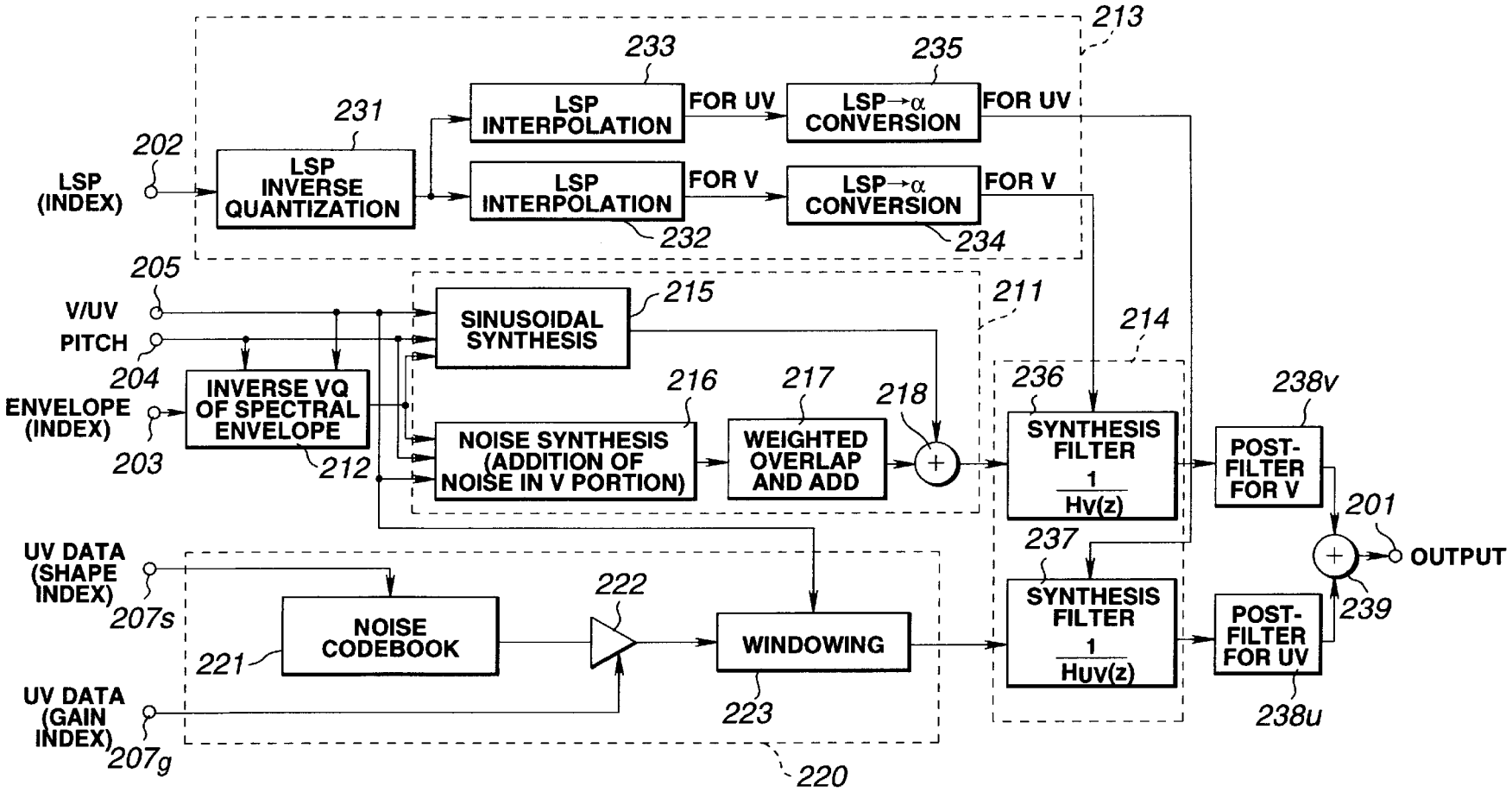
FIG. 4 is a block diagram showing a more specified structure of a speech decoding apparatus embodying the present invention.

FIG. 4 shows a more detailed structure of a speech signal decoder shown in FIG. 2. In FIG. 4, the same numerals are used to denote the components shown in FIG. 2.

In FIG. 4, a vector quantization output of the LSPs corresponding to the output terminal 102 of FIGS. 1 and 3, that is the codebook index, is supplied to an input terminal The LSP index is sent to the inverted vector quantizer 231 of the LSP for the LPC parameter reproducing unit 213 so as to be inverse vector quantized to line spectral pair (LSP) data which are then supplied to LSP interpolation circuits 232, 233 for LSP interpolation. The resulting interpolated data is converted by the LSP-to-α conversion circuits 234, 235 to α parameters which are sent to the LPC synthesis filter 214. The LSP interpolation circuit 232 and the LSP-to-α conversion circuit 234 are designed for voiced (V) sound, while the LSP interpolation circuit 233 and the LSP-to-α conversion circuit 235 are designed for unvoiced (UV) sound. The LPC synthesis filter 214 is made up of the LPC synthesis filter 236 of the voiced speech portion and the LPC synthesis filter 237 of the unvoiced speech portion. That is, LPC coefficient interpolation is carried out independently for the voiced speech portion and the unvoiced speech portion for prohibiting any ill effects which might otherwise be produced in the transient portion from the voiced speech portion to the unvoiced speech portion or vice versa by interpolation of the LSPs of totally different properties.

To an input terminal 203 of FIG. 4 is supplied code index data corresponding to the weighted vector quantized spectral envelope Am corresponding to the output of the terminal 103 of the encoder of FIGS. 1 and 3. To an input terminal 204 is supplied pitch data from the terminal 104 of FIGS. 1 and 3 and, to an input terminal 205 is supplied V/UV discrimination data from the terminal 105 of FIGS. 1 and 3.

The vector-quantized index data of the spectral envelope Am from the input terminal 203 is sent to an inverted vector quantizer 212 for inverse vector quantization where a conversion inverted from the data number conversion is carried out. The resulting spectral envelope data is sent to a sinusoidal synthesis circuit 215.

If the inter-frame difference is found prior to vector quantization of the spectrum during encoding, inter-frame difference is decoded after inverse vector quantization for producing the spectral envelope data.

The sinusoidal synthesis circuit 215 is fed with the pitch from the input terminal 204 and the V/UV discrimination data from the input terminal 205. From the sinusoidal synthesis circuit 215, LPC residual data corresponding to the output of the LPC inverse filter 111 shown in FIGS. 1 and 3 are taken out and sent to an adder 218. The specified technique of the sinusoidal synthesis is disclosed in, for example, JP Patent Application Nos. 4-91442 and 6-198451 proposed by the present Assignee.

The envelope data of the inverse vector quantizer 212 and the pitch and the V/UV discrimination data from the input terminals 204, 205 are sent to a noise synthesis circuit 216 configured for noise addition for the voiced portion (V). An output of the noise synthesis circuit 216 is sent to an adder 218 via a weighted overlap-and-add circuit 217. Specifically, the noise is added to the voiced portion of the LPC residual signals, in consideration that, if the excitation as an input to the LPC synthesis filter of the voiced sound is produced by sine wave synthesis, a buzzing feeling is produced in the low-pitch sound, such as male speech, and the sound quality is abruptly changed between the voiced sound and the unvoiced sound, thus producing an unnatural hearing feeling. Such noise takes into account the parameters concerned with speech encoding data, such as pitch, amplitudes of the spectral envelope, maximum amplitude in a frame or the residual signal level, in connection with the LPC synthesis filter input of the voiced speech portion, that is excitation.

A sum output of the adder 218 is sent to a synthesis filter 236 for the voiced sound of the LPC synthesis filter 214 where LPC synthesis is carried out to form time waveform data which then is filtered by a post-filter 238*v* for the voiced speech and sent to the adder 239.

The shape index and the gain index, as UV data from the output terminals 107*s* and 107*g* of FIG. 3, are supplied to the input terminals 207*s* and 207*g* of FIG. 4, respectively, and thence supplied to the unvoiced speech synthesis unit 220. The shape index from the terminal 207*s* is sent to the noise codebook 221 of the unvoiced speech synthesis unit 220, while the gain index from the terminal 207*g* is sent to the gain circuit 222. The representative value output read out from the noise codebook 221 is a noise signal component corresponding to the LPC residuals of the unvoiced speech. This becomes a pre-set gain amplitude in the gain circuit 222 and is sent to a windowing circuit 223 so as to be windowed for smoothing the junction to the voiced speech portion.

An output of the windowing circuit 223 is sent to a synthesis filter 237 for the unvoiced (UV) speech of the LPC synthesis filter 214. The data sent to the synthesis filter 237 is processed with LPC synthesis to become time waveform data for the unvoiced portion. The time waveform data of the unvoiced portion is filtered by a post-filter for the unvoiced portion 238*u* before being sent to an adder 239.

In the adder 239, the time waveform signal from the post-filter for the voiced speech 238*v* and the time waveform data for the unvoiced speech portion from the post-filter 238*u* for the unvoiced speech are added to each other and the resulting sum data is taken out at the output terminal 201.

Figure 5:
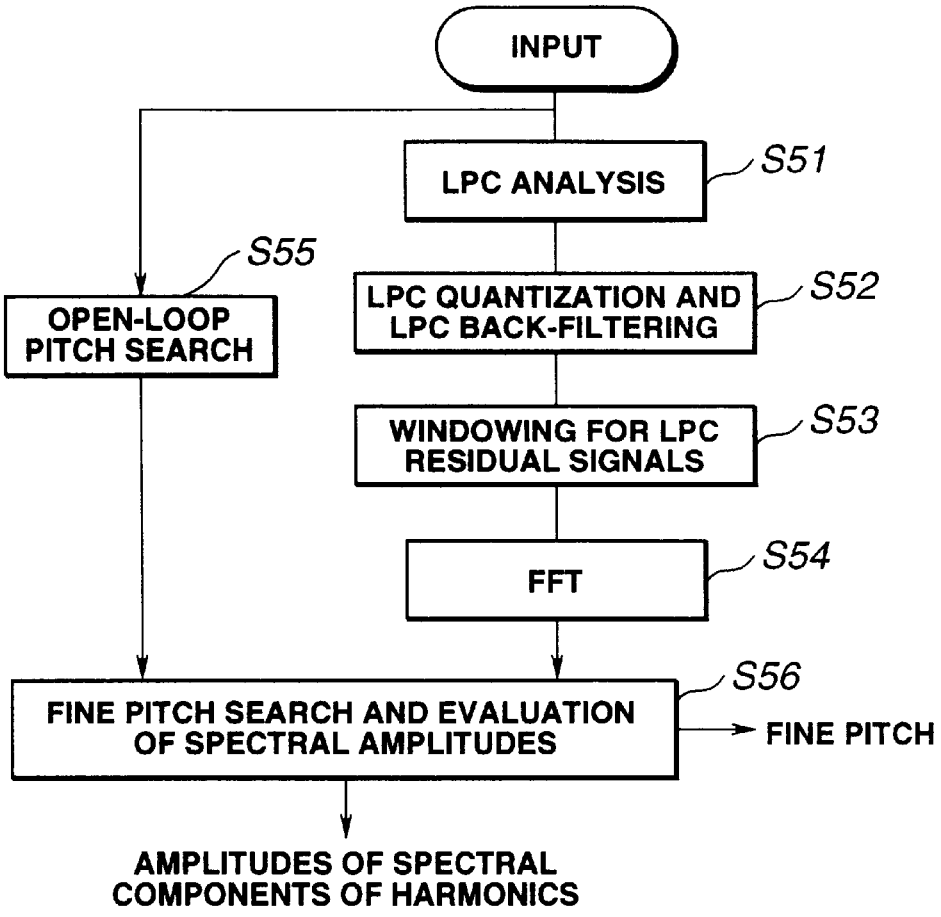
FIG. 5 shows a basic sequence of operations in evaluating the amplitude of harmonics.

The basic operations of processing by the first encoding unit 110, in which the speech analysis method according to the present invention is applied, is shown in FIG. 5.

The input speech signal is fed to an LPC analysis step S51 and to an open-loop pitch search (rough pitch search) step S55.

In the LPC analysis step S51, a Hamming window is applied, with the length of 256 samples of the input signal waveform as one block, for finding linear prediction coefficients, or so-called α-parameters, by the autocorrelation method.

Then, at the LSP quantization and LPC inverted filtering step S52, the α-parameters, as found at step S52, are matrix- or vector-quantized by the LPC quantizer. On the other hand, the α-parameters are sent to the LPC inverted filter for taking out linear prediction residuals (LPC residuals) of the input speech signal.

Figure 6:
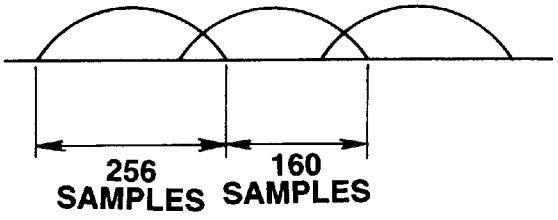
FIG. 6 illustrates overlapping of the frequency spectrums processed from frame to frame.

Then, at the windowing step S53 for the LPC residual signals, an appropriate window, such as a Hamming window, is applied to the LPC residual signals taken out at step S52. The windowing is across two neighboring frames, as shown in FIG. 6.

Next, at the FFT step S54, the LPC residuals, windowed at step S53, are FFTed at for example 250 points for conversion to FFT spectral components which are parameters on the frequency axis. The spectrum of the speech signals, FFTed at N points, is made up of X(0) to X(N/2−1) spectral data in association with 0 to π.

At the open-loop pitch search (rough pitch search) step S55, the LPC residuals of the input signal are taken to perform rough pitch search by the open loop to output a rough pitch.

At the fine pitch search and spectral amplitude evaluation step S56, the spectral amplitudes are calculated, using the FFT spectral data obtained at step S55 and a pre-set base.

The spectral amplitude evaluation in the orthogonal transform circuit 145 and the spectral evaluation unit 148 of the speech encoder shown in FIG. 3 are specifically explained.

First, parameters used in the following explanation X(j), E(j) and A(m) are defined as follows:

Xj) (1≦j≦128): FFT spectrum

Ej) (1≦j≦128): base

A(m): amplitude of harmonics.

An evaluation error ε(m) of the spectral amplitudes is given by the following equation (1):

$$\epsilon(m) = \sum_{j=a_m}^{b_m} (|X(j)| - |A(m)||E(j)|)^2 \tag{1}$$

The above FFT spectrum X(j) is a parameter on the frequency axis obtained on Fourier transform by the orthogonal transform. The base E(j) is assumed to have been pre-set.

The following equation:

$$\frac{\delta s(m)}{\delta|A(m)|} = -2\sum_{j=a_m}^{b_m}\{|X(j)| - |A(m)||E(j)|\}|E(j)| = 0$$

as obtained by differentiating the equation (1) and setting the result to 0, is solved to find A(m) which gives an extreme value, that is A(m) which gives a minimum value of the above evaluation error, to give the following equation (2):

$$|A(m)| = \frac{\sum_{j=a_m}^{b_m}|X(j)||E(j)|}{\sum_{j=a_m}^{b_m}|E(j)|^2} \tag{2}$$

In the above equation, a(m) and b(m) denote indices of upper limit and lower limit FFT coefficients of an m'th band obtained on splitting the frequency spectrum from its lower range to its higher range with a sole pitch ω0. The center frequency of the m'th harmonics corresponds to (a(m)+b(m))/2.

Figure 7A:
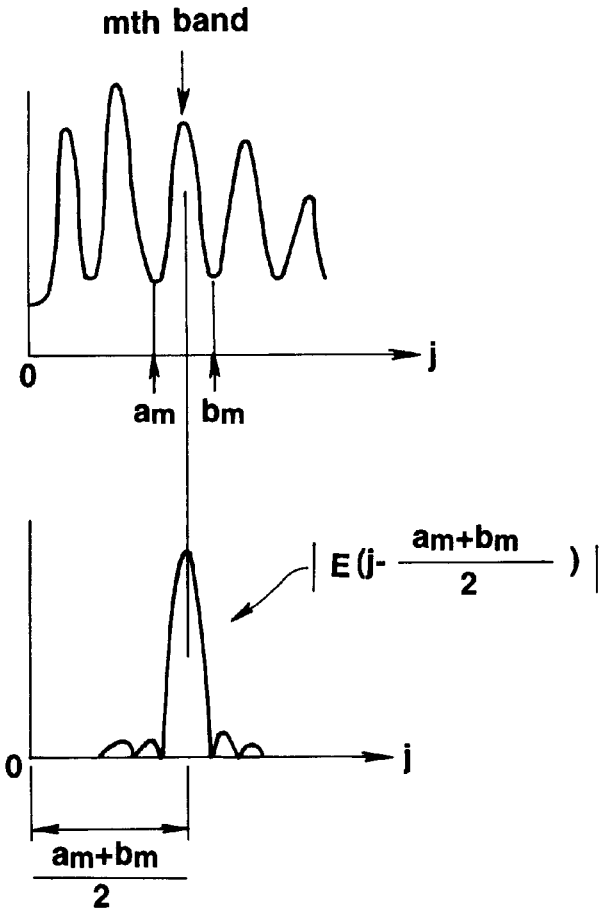
FIGS. 7A and 7B illustrate base generation.
Figure 7B:
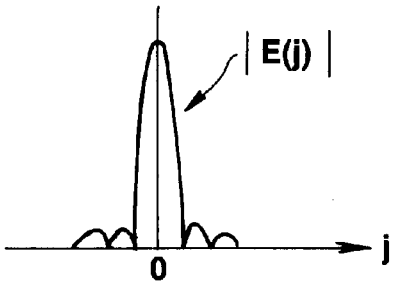

As the above base E(j), the 256-point Hamming window itself may be used. Alternatively, such spectrum may be used which is obtained on padding 0s in the 256-point Hamming window to give e.g., a 2048 point window and FFTing the latter with 256 or 2048 points. It is however necessary in such case to apply offset in the evaluation of the amplitude of the harmonics |A|(m) so that E(0) will be overlapped with a (a(m)+b(m))/2 position as shown in FIG. 7B. In such case, the equation more strictly becomes the following equation (3):

$$|A(m)| = \frac{\sum_{j=a_m}^{b_m}|X(j)|\left|E\left(j-\frac{a_m+b_m}{2}\right)\right|}{\sum_{j=a_m}^{b_m}\left|E\left(j-\frac{a_m+b_m}{2}\right)\right|^2} \tag{3}$$

Similarly, the evaluation error ϵE(m) of the m'th band is as shown in the following equation (4):

$$\epsilon(m) = \sum_{j=a_m}^{b_m}\left(|X(j)| - |A(m)|\left|E\left(j-\frac{a_m+b_m}{2}\right)\right|\right)^2 \tag{4}$$

In this case, the base E(j) is defined in a domain of $-128 \leqq j \leqq 127$ or $-1024 < j \leqq 1023$.

The high-precision pitch search by the high-precision pitch search unit 146 shown in FIG. 3 is specifically explained.

For high-precision amplitude evaluation of the spectrum of harmonics, high-precision pitch needs to be obtained. That is, if the pitch is of low precision, amplitude evaluation cannot be achieved correctly, such that a clear playback speech cannot be produced.

Turning to the basic sequence of operations of the pitch search in the speech analysis method according to the present invention, a rough pitch value $P_0$ is obtained by previous rough open-loop pitch search carried out by the open-loop pitch search unit 141. Based on this rough pitch value $P_0$, two-step fine pitch search, consisting in the integer search and the fractional search, is then carried out by the fine pitch search unit 146.

The rough pitch, as found by the open-loop pitch search unit 141, is found on the basis of the maximum value of autocorrelation of the LPC residuals of the frame being analyzed, with account being taken of junction to the open-loop pitch (rough pitch) in the forward and backward side frames.

The integer search is carried out for all bands of the frequency spectrum, while the fractional search is carried out for each of bands split from the frequency spectrum.

Referring to the flowchart of FIGS. 9 to 12, a typical sequence of operations of the fine pitch search is explained. The rough pitch value $P_0$ is the value of a so-called pitch lag representing the pitch period in terms of the number of samples, and k denotes the number of times of repetitions of a loop.

The fine pitch search is carried out in the sequence of the integer search, high range side fractional search and the low range side fractional search. In these search steps, pitch search is carried out so that an error between the synthesized spectrum and the original spectrum, that is the evaluation error ϵ(m), will be minimized. Therefore, the amplitude of harmonics |A(m)| given by the equation (3) and the evaluation error ϵ(m) calculated by the equation (4) are included in the fine pitch search step, so that the fine pitch search and the evaluation of the amplitudes of spectral components are carried out simultaneously.

Figure 8A:
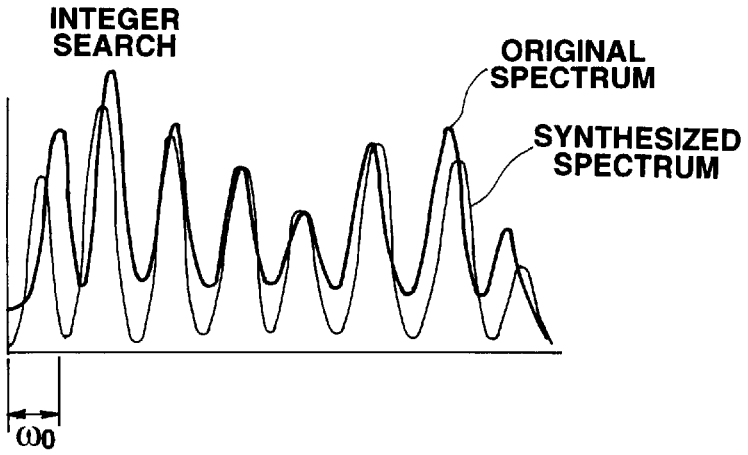
FIGS. 8A, 8B and 8C illustrate integer search and fractional search.

FIG. 8A shows the manner in which pitch detection is carried out for all bands of the frequency spectrum by the integer search. From this it is seen that, if tried to evaluate the amplitudes of the spectral components of the entire bands with sole pitch ω0, there results a larger shift between the original spectrum and the synthesized spectrum, indicating that reliable amplitude evaluation cannot be realized if this method by itself is resorted to.

Figure 9:
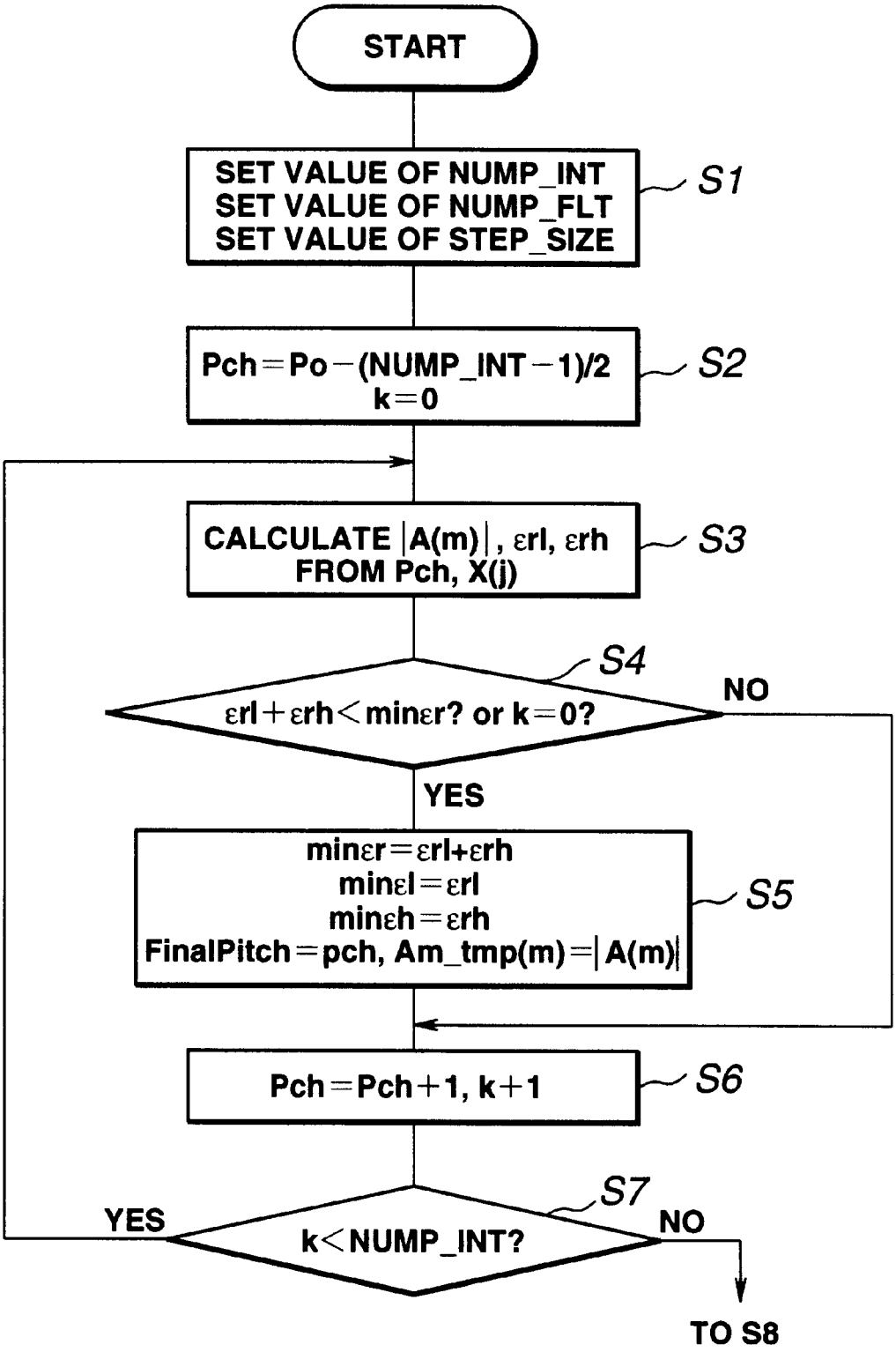
FIG. 9 is a flowchart showing a typical sequence of operations of the integer search.

FIG. 9 shows a specified sequence of operations of the above-described integer search.

At step S1, the values of NUMP_INT, NUMP_FLT and STEP_SIZE, which give the number of samples for integer search, the number of samples for fractional search and the size of the step S for fractional search, respectively, are set. As specified examples, NUMP_INT=3, NUMP_FLT=5 and STEP_SIZE=0.25.

At step S2, an initial value of the pitch Pch is given from the rough pitch $P_0$ and NUMP_INT, while the loop counter is reset, with k being reset (k=0).

At step S3, the amplitude |An| of harmonics, sum of amplitude errors only on the low frequency range $\epsilon_{rl}$ and the sum of amplitude errors only on the high frequency range $\epsilon_{rh}$ are calculated. The specified operation at this step S3 will be explained subsequently.

At step S4, it is checked whether or not 'the sum total of the sum of amplitude errors only on the low frequency range $\epsilon_{rh}$ and the sum of amplitude errors only on the high frequency range $\epsilon_{rh}$ is smaller than min$\epsilon_r$ or k=0'. If this condition is not met, processing transfers to step S6 without passing through step S5. If the above condition is met, processing transfers to step S5 to set min$\epsilon_r$=$\epsilon_{rl}$+$\epsilon_{rh}$ min$\epsilon_{rl}$=$\epsilon_{rl}$ min-68 $_{rh}$=$\epsilon_{rh}$ FinalPitch=$P_{Ch}$'$A_m$_tmp(m)=|A(m)|.

At step S6, $P_{ch}$=$P_{ch}$+1 is set.

At step S7, it is checked whether or not the condition that 'k is smaller than NUMP_INT' is met. If this condition is met, processing reverts to step S3. If otherwise, processing transfers to step S8.

Figure 8B:
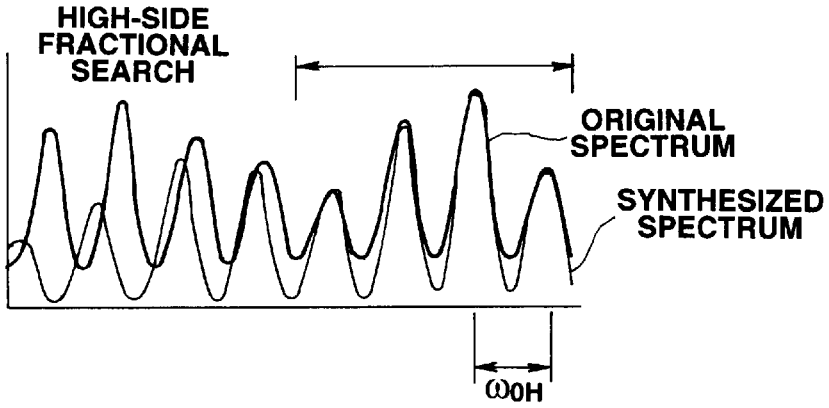

FIG. 8B shows the manner in which pitch detection by fractional search is carried out on the high range side of the frequency spectrum. From this it is seen that the evaluation error on the high frequency range can be made smaller than in case of the integer search carried out for all bands of the frequency spectrum as described previously.

Figure 10:
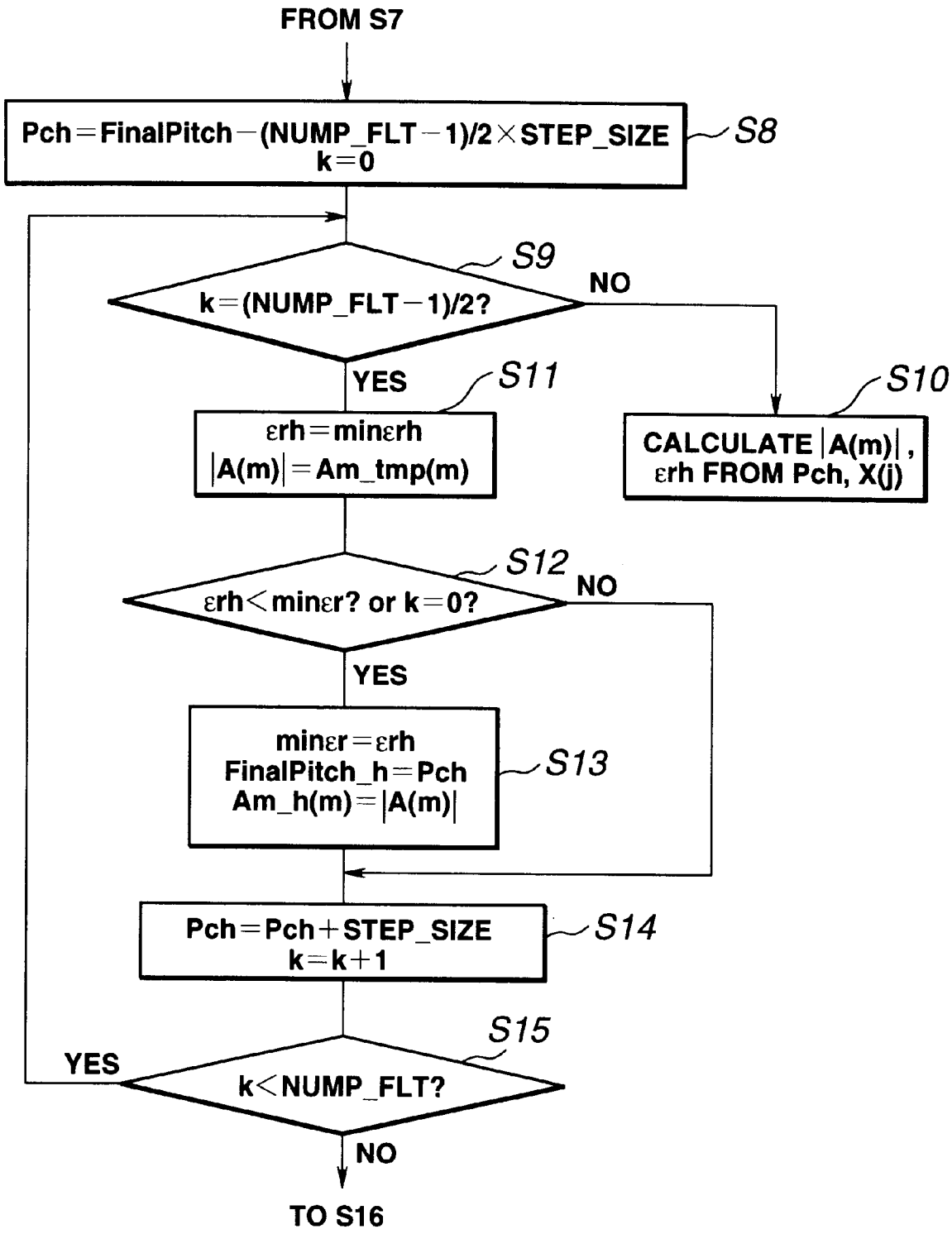
FIG. 10 is a flowchart showing a typical sequence of operations of the integer search in a high frequency range.

FIG. 10 shows a specified sequence of operations of the fractional search on the high frequency range side.

At step S8, $P_{ch}$=FinalPitch−(NUMP_FLT−1)/2×STEP_SIZE k=0 are set. FinalPitch is the pitch obtained by the integer search of all bands described above.

At step S9, it is checked whether or not the condition that 'k=(NUMP_FLT−1)/2 is met. If this condition is not met, processing transfers to step S10. If this condition is met, processing transfers to step S11.

At step S10, the amplitude |Am| of harmonics and the sum $\epsilon_{rh}$ of amplitude errors only on the high frequency range side are calculated from the pitch $P_{ch}$ and the spectrum X(j) of the input speech signal, before processing transfers to step S12. The specified operations at this step S10 are explained subsequently.

At step S11, $\epsilon_{rh}$=min$\epsilon_{rh}$

|A(m)|=$A_m$−tmp(m)

are set, before processing transfers to step S12.

At step S12, it is checked whether or not the condition that '$\epsilon_{rh}$ is smaller than min$\epsilon_r$ or k=0' is met. If this condition is not met, processing transfers to step S14 without passing through step S13. If the above condition is met, processing transfers to step S13.

At step S13, min$\epsilon_r$=$\epsilon_{rh}$

FinalPitch_=$P_{ch}$ $A_m$−h(m)=|A(m)| are set.

At step S14, $P_{ch}$=$P_{ch}$+STEP_SIZE k=k+1 are set.

At step S15, it is checked whether or not the condition that 'k is smaller than NUMP_FLT' is met. If this condition is met, processing reverts to step S9. If the above condition is not met, processing transfers to step S16.

Figure 8C:
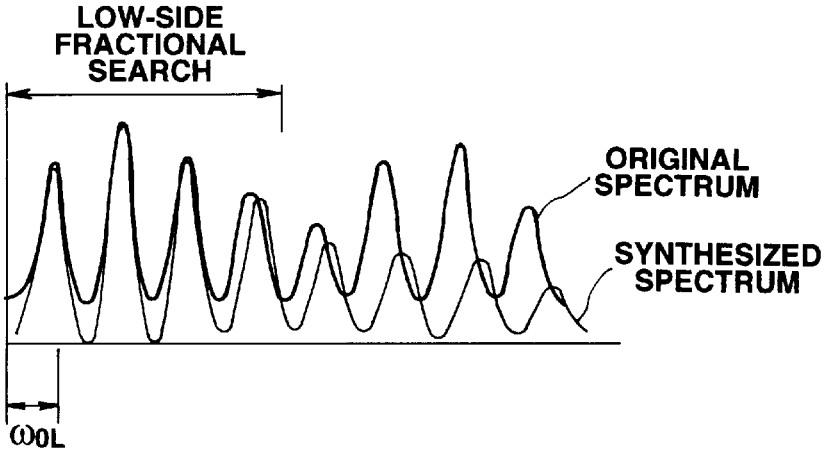

FIG. 8C the manner in which pitch detection is carried out by fractional search on the low frequency range side of the frequency spectrum. It is seen from this that the evaluation error on the low range side can be made smaller than in case of the integer search for the entire frequency spectrum.

Figure 11:
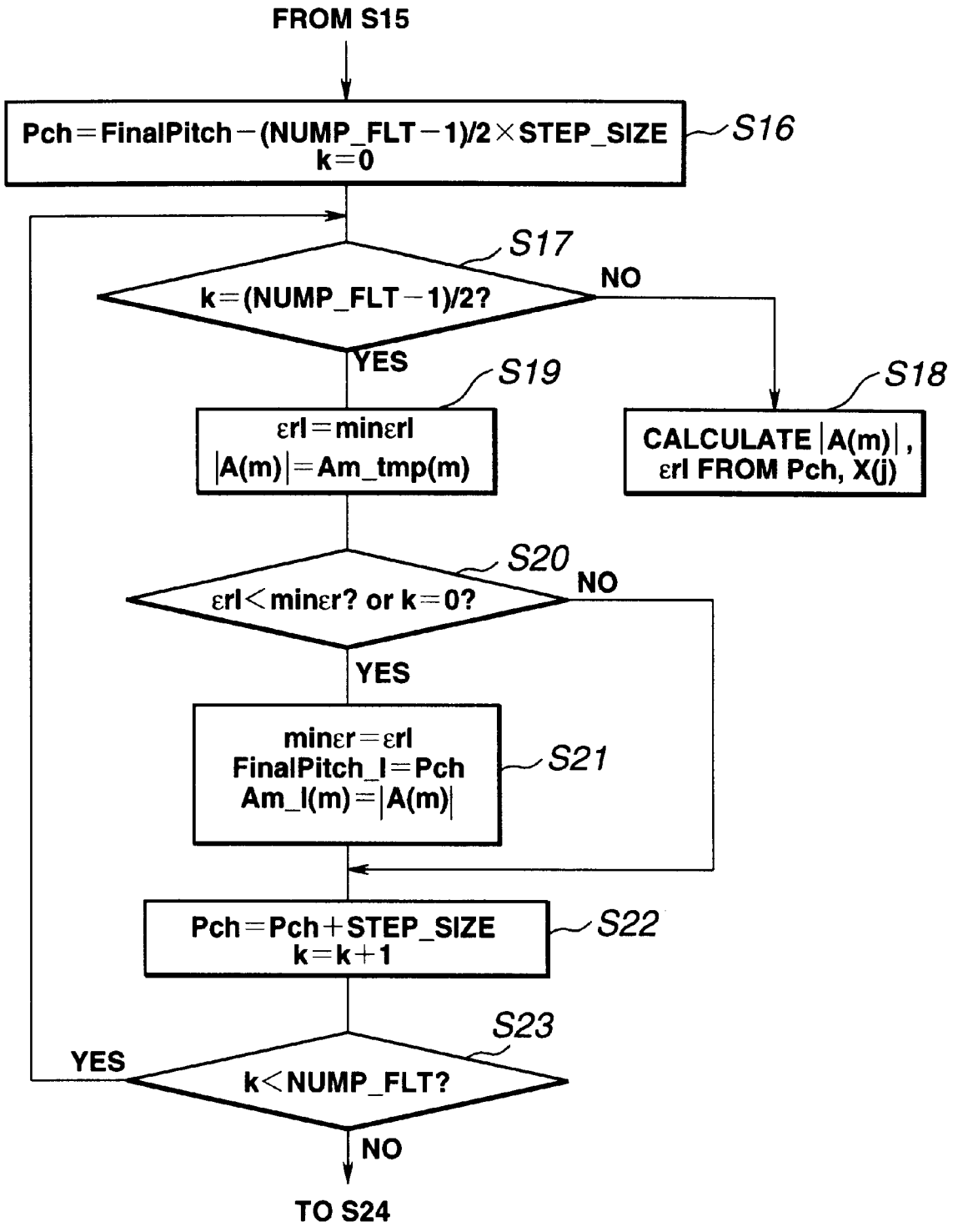
FIG. 11 is a flowchart showing a typical sequence of operations of the integer search in a low frequency range.

FIG. 11 shows a specified sequence of operations of the fractional search on the low range side.

At step S16, $P_{ch}$=FinalPitch−(NUMP_FLT−1)/2×STEP−SIZE k=0 are set. FinalPitch is a pitch obtained by integer search of the entire spectrum described previously.

At step S17, it is checked whether or not the condition that 'k is equal to (NUMP−FLT−1)/2 is met. If this condition is not met, processing transfers to step SI 8. If the above condition is met, processing transfers to step S19.

At step S18, the amplitudes f harmonics |An| and the amplitude errors only on the low range side are calculated, from the pitch $P_{ch}$ and the spectrum X(j) of the input speech signal, before processing transfers to step S20. The specified operations at this step S18 will be explained subsequently.

At step S19, $\epsilon_{rl}$=min$\epsilon_{rl}$

|A(m)|=$A_m$_TMP(m) are set, before processing transfers to step S20.

At step S20, it is checked whether or not the condition that '$\epsilon_{rl}$ is smaller than min$\epsilon_r$ or k=0' is met. If this condition is not met, processing transfers to step S22 without passing through step S21. If the above condition is met, processing transfers to step S21.

At step S21, min$\epsilon_r$=$\epsilon_{rl}$

FinalPitch_l=$P_{ch}$ $A_m$_l(m)=|A(m)| are set.

At step S22, $P_{ch}$=$P_{ch}$+STEP-SIZE k=k+1 are set.

At step S23, it is judged whether or not the condition that 'k is smaller than NUMP−FLT' is met. If this condition is met, processing reverts to step S17. If the above condition is not met, processing transfers to step S24.

Figure 12:
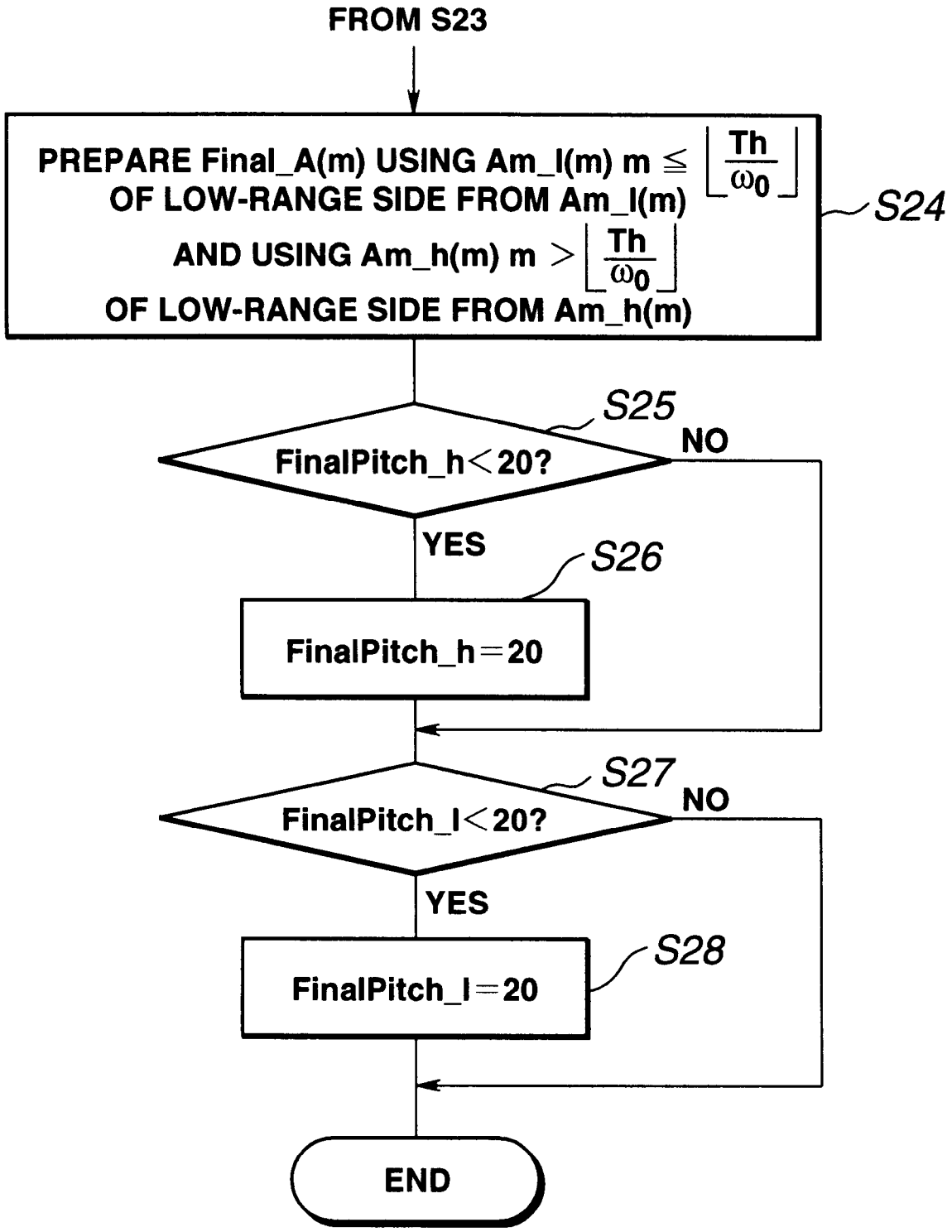
FIG. 12 is a flowchart showing a typical sequence of operations for ultimately setting the pitch.

FIG. 12 specifically shows the sequence of operations of generating an ultimately outputted pitch from pitch data obtained by the integer search for all bands of the frequency spectrum and the fractional search for both high and low range sides shown in FIGS. 9 to 11.

At step S24, Final_$A_m$(m) is produced using $A_m$_l(m) on the low range side from $A_m$_l(m) and also using $A_m$_h(m) on the high range side from $A_m$_h(m).

At step S25, it is checked whether or not the condition that 'FinalPitch_h is smaller than 20' is met. If this condition s not met, processing transfers to step SS27 without passing through step S26. If the above condition is not met, processing transfers to step S26.

At step S26,

FinalPitch_h=20 is set.

At step S27, it is checked whether or not the condition that 'FinalPitch_1 is smaller than 20' is met. If this condition is not met, processing is terminated without passing through step S26. If the above condition is not met, processing transfers to step S28.

At step S28,

FinalPitch_1=20 is set to terminate the processing.

The above steps S25 to S28 show a case in which the minimum pitch is limited with 20.

The above sequence of operations gives FinalPitch_1, FinalPitch_h and Final_$A_m$(m).

Figure 13:
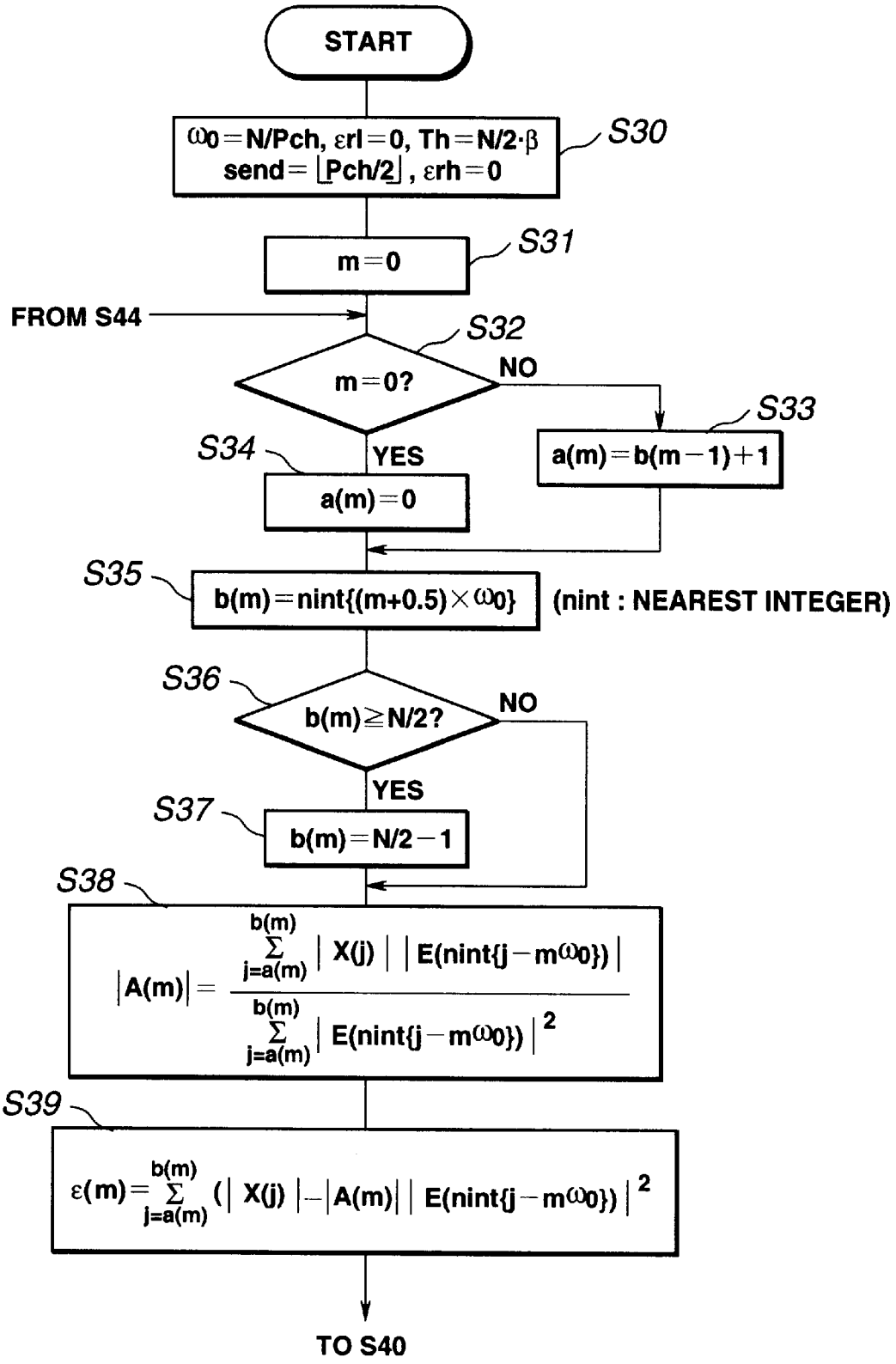
FIG. 13 is a flowchart showing a typical sequence of operations for finding an amplitude of the harmonics optimum for each frequency range.
Figure 14:
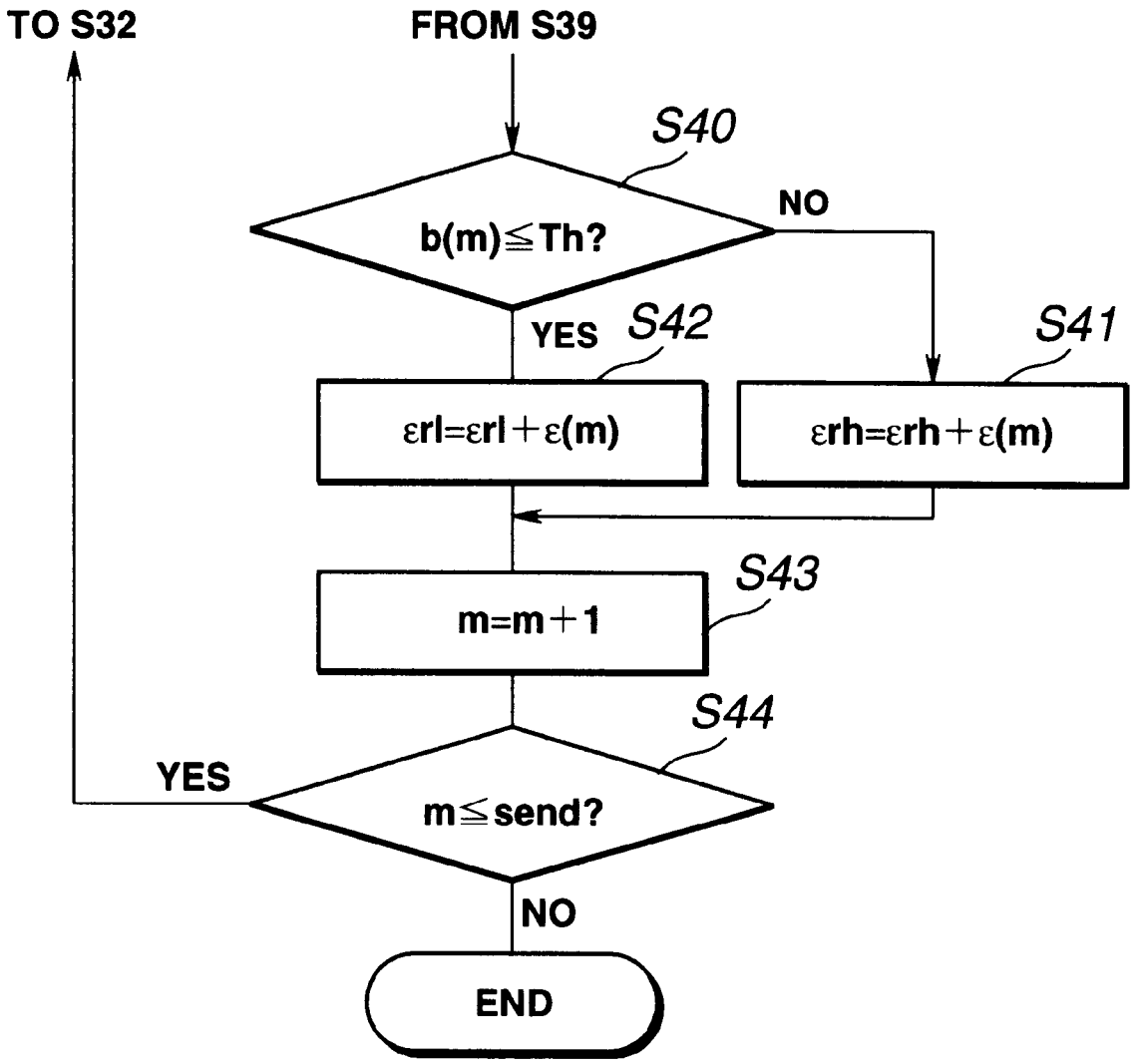
FIG. 14 is a flowchart, continuing from FIG. 13, for showing a typical sequence of operations for finding an amplitude of the harmonics optimum for each frequency range.

FIGS. 13 and 14 show illustrative means for finding the amplitudes of optimum harmonics in the bands split from the frequency spectrum based on the pitch as obtained by the above-described pitch detection process.

At step S30, $\omega_0$=N/$P_{ch}$

Th=N/2·β

$\epsilon_{rl}$=0

$\epsilon_{rh}$=0 and $$send = \left\lfloor \frac{Pch}{2} \right\rfloor$$

are set, where $\omega_0$ is the pitch in case of representing the range from the low to the high ranges with one pitch, N is the number of samples used in FFTing LPC residuals of speech signals and Th is an index for distinguishing the low range side from the high range side. On the other hand, $\beta$ is a pre-set variable with an illustrative value of $\beta$=50/125. In the above equation, send is the number of harmonics in the entire frequency spectrum and has an integer value by rounding off fractional portions of the pitch $P_{ch}/2$.

At step S31, the value of m, which is a variable specifying the m'th band of the frequency spectrum split on the frequency axis into plural bands, that is a band corresponding to the m'th harmonics, is set to 0.

At step S32, the condition whether or not 'the value of m is 0' is scrutinized. If this condition is not met, processing transfers to step S33. If the above condition is met, processing transfers to step S34.

At step S33, $a(m)=b(m-1)+1$ is set.

At step S34, a(m) is set to 0.

At step S35, $b(m)=nint((m+0.5)\times\omega_0)$ where nint gives a closest integer, is set.

At step S36, the condition whether or not 'b(m) is not less than N/2' is scrutinized. If this condition is not met, processing transfers to step S38 without passing through step S37. If the above condition is met, $b(m)=N/2-1$ is set.

At step S38, the amplitude of harmonics |A(m)| represented by the following equation:

$$|A(m)| = \frac{\sum_{j=a_m}^{b_m} X(j)\left|E(nint\{(j-m\omega_0)\})\right|}{\left|\sum_{j=a_m}^{b_m} \left|E(nint(j-m\omega_0\right\}\right)\right|^2}$$

is set.

At step S39, the evaluation error $\epsilon$(m), represented by the following equation:

$$\varepsilon(m) = \sum_{j=a_m}^{b_m} (|X(j)| - |A(m)|E(nint\{j-m\omega_0\})|)^2$$

is set. At step S40, it is judged whether or not the condition that 'b(m) is not larger than Th' is met. If this condition is not met, processing transfers to step S41. If the above condition is met, processing transfers to step S42.

At step S41, $\epsilon_{rh}=\epsilon_{rh}+\epsilon(m)$ is set. At step S42, $\epsilon_{rl}=\epsilon_{rl}+\epsilon(m)$ is set. At step S43, $m=m+1$ is set.

At step S44, it is checked whether or not the condition that 'm is not more than send is met. If this condition is met, processing reverts to step S32. If the above condition is not met, processing is terminated.

If the base E(j) obtained on sampling with a rate R times as large as X(j) is used, the amplitude of harmonics |A(m)| and the evaluation error $\epsilon$(m) are given by the equation:

$$|A(m)| = \frac{\sum_{j=a_m}^{b_m} (|X(j)||E(nint + \{(j-m\omega_0)\cdot R\})|}{\sum_{j=a_m}^{b_m} |E(nint + \{(j-m\omega_0)\cdot R\})|^2}$$

and by the equation:

$$\varepsilon(m) = \sum_{j=a_m}^{b_m} (|X(j)| - |A(m)||E(nint + \{(j-m\omega_0)\cdot R\})|)^2$$

respectively.

For example, such a base E(j) may be used which is obtained by padding 0's in the 256-point Hamming window and carrying out 2048-point FFT followed by octatupled oversampling.

For pitch detection in the speech analysis method of the present invention, optimum values of the amplitude of harmonics may be obtained for each band of the frequency spectrum by independently optimizing minimizing) the sum of the amplitude errors only on the low frequency range side $\epsilon_{rl}$ and the amplitude errors only on the high frequency range side $\epsilon_{rh}$.

That is, if only the sum of the amplitude errors only on the low frequency range side $\epsilon_{rl}$ is required in the above step S18, it suffices to carry out the above processing for the domain of from m=0 to m=Th. Conversely, if only the sum of the amplitude errors only on the low frequency range side $\epsilon_{rh}$ is required in the step S10, it suffices to carry out the above processing for the domain of substantially from m=Th to m=send. It is however necessary in this case to carry pout junction processing for slight overlap between the low and high frequency range sides for preventing the harmonics in the junction area from being dropped due to pitch shifting between the low and high frequency range sides.

In an encoder for carrying out the above speech analysis method, the pitch actually transmitted may be FinalPitch_l or FinalPitch_h, whichever is desired. The reason is that if, at the time of synthesizing and decoding the encoded speech signal in a decoder, the position of the harmonics is deviated to a more or less extent, the amplitudes of the harmonics are correctly evaluated in the entire frequency spectrum thus presenting no problem. If, for example, FinalPitch_1 is transmitted as a pitch parameter to the decoder, the spectral position on the high frequency range side appears at a slightly offset position from the inherent position, that is the as-analyzed position. However, this offset is not psychoacoustically objectionable.

Of course, if there is allowance in the bit rate, both FinalPitch_1 or FinalPitch_h may be transmitted as pitch parameters, or the difference between FinalPitch_1 and FinalPitch_h may be transmitted, in which case the decoder applies FinalPitch_1 and FinalPitch_h to the low-range side spectrum and to the high-range side spectrum to perform sinusoidal analysis to produce a more spontaneous synthesized sound. Although the integer search is carried out in the above-described embodiment on the entire frequency spectrum, integer search may be carried out for each of the split bands.

Meanwhile, the speech encoding device can output data of different bit rates in meeting with the required speech quality so that output data is outputted with varying bit rates.

Specifically, the bit rate of the output data can be switched between low bit rate and high bit rate. For example, if the low bit rate is 2 kbps and the high bit rate is 6 kbps, output data may be of the bit rates shown in FIG. 15.

The pitch information from an output terminal 104 is outputted for voiced speech at 8 bits/20 msec at all times, with the V/UV decision output of the output terminal 105 being 1 bit/20 msec at all times. The index data for LSP quantization outputted at an output terminal 102 is switched between 32 bits/40 msec and 48 bits/40 msec. On the other hand, the index for voiced speech (V) outputted at an output terminal 103 are switched between 15 bits/20 msec and 87 bits/20 msec, while index data for unvoiced speech (UV) is switched between 11 bits/10 msec and 23 bits/5 msec. Thus, output data for voiced speech (V) is 40 bits/20 msec and 120 bits/20 msec for 2 kbps and 6 kbps, respectively. Output data for unvoiced speech (UV) is 39 bits/20 msec and 117 bits/20 msec for 2 kbps and 6 kbps, respectively. The index data for LSP quantization, the index data for voiced speech (V) and the index data for unvoiced speech (UV) will be subsequently explained in connection with related components.

A specified structure of the voiced/unvoiced (V/UV) decision unit 115 in the speech encoder of FIG. 3 will now be explained.

In the voiced/unvoiced (V/UV) decision unit 115, the V/UV decision for the current frame is given on the basis of an output of the orthogonal transform unit 145, an optimum pitch from the fine pitch search unit 146, spectral amplitude data from the spectral evaluation unit 148, normalized maximum value of autocorrelation r'(1) from the open-loop pitch search unit 141 and zero-crossing count values from the zero-crossing counter 412. The boundary positions of the band-based V/UV decision results similar to those for MBE are also used as a condition for V/UV decision of the current frame.

The V/UV decision results employing the band-based V/UV decision results for MBE are now explained.

A parameter representing the magnitude of the m'th harmonics for NME, or the amplitude $|A_m|$, is represented by the following equation:

$$|A(m)| = \frac{\sum_{j=a_m}^{b_m} |X(j)||E(j)|}{\sum_{j=a_m}^{b_m} |E(j)|^2}$$

In the above equation, |X(j)| is the spectrum obtained on DFTing LPC residuals while |E(j)| is the spectrum of the base signal, obtained on DFTing the 256-point Hamming window. The noise-to-signal ratio (NSR) is represented by the following equation:

$$NSR = \frac{\sum_{j=a_m}^{b_m} \{|X(j)| - |Am||E(j)|\}^2}{\sum_{j=a_m}^{b_m} |S(j)|^2}$$

If the NSR value is larger than a pre-set threshold value, such as 0.3, that is if an error is larger, approximation of |X(j)| by |An|E(j)| for the band can be judged to be not good, that is the excitation signal |E(j)| can be judged to be inadequate as the base. Therefore, the band is judged to be unvoiced (UV). Otherwise, the approximation can be judged to be fairly satisfactory so that the band is judged to be voiced (V).

The NSR of the respective bands (harmonics) represent spectral similarity from one harmonics to another. The gain-weighted sum of the harmonics of the NSR or $NSR_{all}$ is define by:

$$NSR_{all}=(\Sigma_m|A_m|NSR_M)/(\Sigma_m|A_m|)$$

The rule base used for V/UV decision is determined depending on whether this spectral similarity $NSR_{all}$ is larger or smaller than a certain threshold value. This threshold value herein is set to $Th_{NSR}$=0.3. This rule base is concerned with the maximum values of autocorrelation of LPC residuals, frame power and zero-crossing. With a rule base used for $NSR_{all}<Th_{NSR}$, the frame is V or UV if the rule is applied or if there is no applicable rule, respectively.

The specified rules are as follows:

With $NSR_{all}<Th_{NSR}$, if numZeroXP<24, frmpow>340 and r0>0.32, then the frame is V.

With $NSR_{all}\geqq Th_{NSR}$, if numZeroXP>30, frmpow<9040 and r0<0.23, then the frame is UV.

In the above, the variables are defmed as follows:

numZeroXP: number of times of zero-crossings per frame frmPow: frame power r'(1) : maximum autocorrelation value.

The V/UV decision is made by having reference to the rule base which is a set of rules such as those given above. Meanwhile, if the pitch search for plural bands is applied to band-based V/UV decision for MBE, mistaken operations due to shifted harmonics can be prevented form occurrence to enable more accurate V/UV decision.

Figure 16:
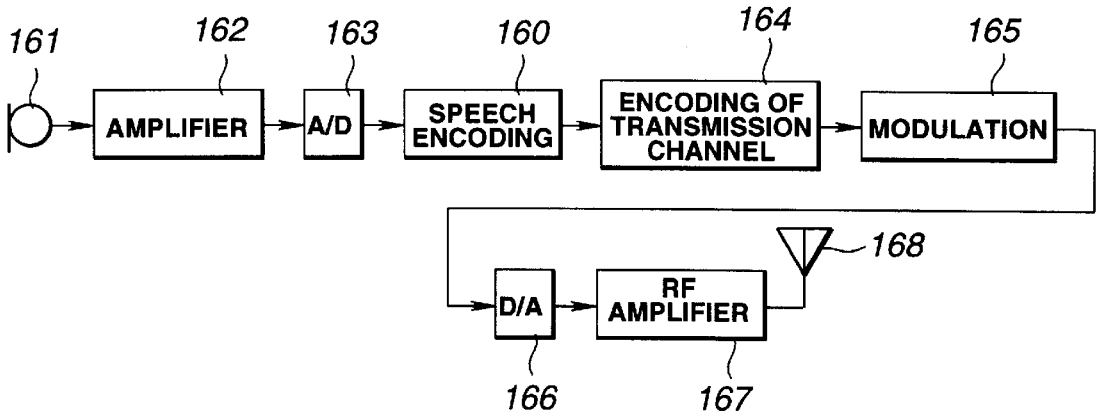
FIG. 16 is a block diagram showing the structure of a transmitting end of a portable terminal employing a speech encoding apparatus embodying the present invention.
Figure 17:
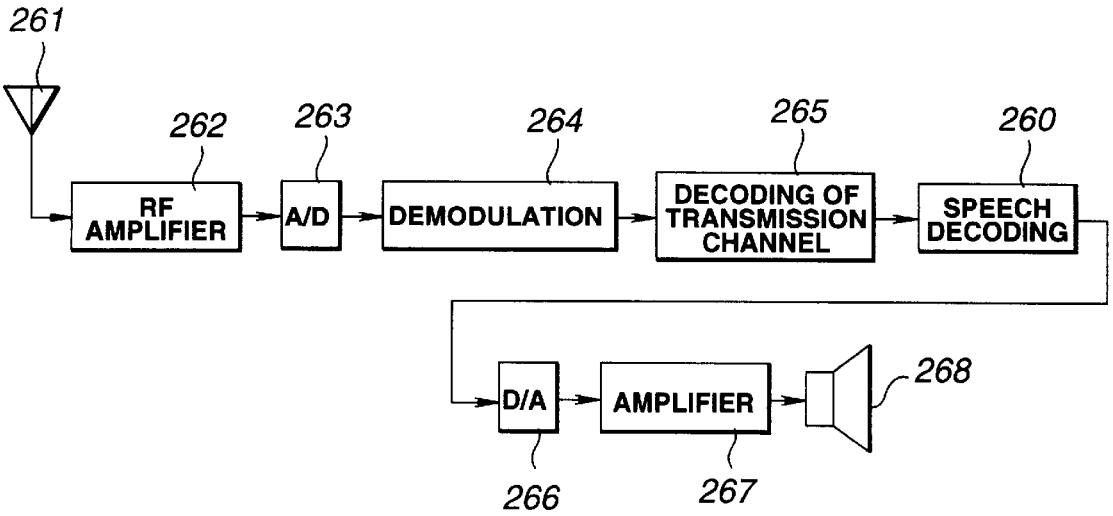
FIG. 17 is a block diagram showing the structure of a receiving end of a portable terminal employing a speech encoding apparatus embodying the present invention.

The signal encoding device and the signal decoding device, as described above, may be used as a speech codec used for a portable communication terminal or a portable telephone shown for example in FIGS. 16 and 17.

Specifically, FIG. 16 shows the structure of a transmitting end of the portable terminal employing a speech encoding unit 160 configured as shown in FIGS. 1 and 3. The speech signals, collected by a microphone 161, are amplified by an amplifier 162 and converted by an A/D converter 163 into digital signals which are then sent to a speech encoding unit 160. This speech encoding unit 160 is configured as shown in FIGS. 1 and 3. To an input terminal of the unit 160 are sent the digital signals from the A/D converter 163. The speech encoding unit 160 performs the encoding operation as explained with reference to FIGS. 1 and 3. Output signals of the output terminals of FIGS. 1 and 2 are sent as output signals of the speech encoding unit 160 to a transmission path encoding unit 164 where channel coding is applied to the signals. The output signals of the transmission path encoding unit 164 are sent to a modulation circuit 165 for modulation and the resulting modulated signals are sent via digital/analog (D/A) converter 166 and an RF amplifier 167 to an antenna 168.

FIG. 17 shows a receiver configuration of a portable terminal employing a speech decoding unit 260 having the basic structure as shown in FIGS. 2 and 4. The speech signals received by an antenna 261 of FIG. 17 are amplified by an RF amplifier 262 and sent via an analog/digital (A/D) converter 263 to a demodulation circuit 264 for demodulation. The demodulated signals are sent to a transmission path decoding unit 265. Output signals of the demodulation circuit 264 are sent to the speech decoding unit 260 where decoding as explained with reference to FIG. 2 is carried out.

An output signal of the output terminal 201 of FIG. 2 is sent as a signal from the speech decoding unit 260 to a digital/analog (D/A) converter 266, an output analog speech signal of which is sent to a speaker 268.

The present invention is not limited to the above-described embodiments which are merely illustrative of the invention. For example, the configurations of the speech analysis side (encoder side) of FIGS. 1 and 3 or the speech synthesis side (decoder side) of FIGS. 2 and 4, explained as hardware, may be implemented by a software program using a so-called digital signal processor (DSP). The scope of application of the present invention is not limited to transmission or recording/reproduction but may encompass pitch conversion, speed conversion, synthesis of speech by rule or noise suppression.

The configuration of the speech analysis side (encoding side) of FIG. 3, explained as hardware, may similarly be realized by a software program using a so-called digital signal processor (DSP).

The present invention is not limited to transmission or recording/reproduction but may be applied to a variety of other usages such as pitch conversion, speed conversion, synthesis of speech by rule or noise suppression.

What is claimed is:

1. A speech analysis method in which an input speech signal is divided on the time axis in terms of a pre-set encoding unit and a pitch equivalent to a basic period of the Input speech signal thus divided into the encoding units is detected, and in which the input speech signal is analyzed from one encoding unit to another based on the detected pitch, comprising the steps of:

splitting the frequency spectrum of the input speech signal into a predetermined plurality of frequency bands on the frequency axis; and simultaneously carrying out a pitch search and an evaluation of amplitudes of harmonics using a detected pitch derived from a spectral shape from one band to another by minimizing an evaluation error of the amplitudes of harmonics over each of the predetermined plurality of frequency bands, wherein the pitch search and the evaluation of the amplitudes of harmonics are carried out based on a rough pitch detected by an open-loop search prior to performing the pitch search and evaluation.

2. The speech analysis method as claimed in claim 1 wherein the spectral shape has a structure of the harmonics.

3. The speech analysis method as claimed in claim 1 wherein the pitch search is a high-precision pitch search obtained by the steps of carrying out a first pitch search based on the rough pitch detected by said rough pitch search and a second pitch search of higher precision than said first pitch search, and wherein said second pitch search is independently performed in each of a high frequency range side and a low frequency range side of the frequency spectrum.

4. The speech analysis method as claimed in claim 3 wherein the first pitch search is carried out for the entire frequency spectrum and wherein the second pitch search is carried out independently for each of the high frequency range side and the low frequency range side of the frequency spectrum.

5. A speech encoding method in which an input speech signal is divided on the time axis in terms of a pre-set encoding unit and a pitch equivalent to a basic period of the input speech signal thus divided into the encoding units is detected, and in which the input speech signal is encoded from one encoding unit to another based on the detected pitch, comprising the steps of:

splitting the frequency spectrum of the input speech signal into a predetermined plurality of frequency bands on the frequency axis; and simultaneously carrying out a pitch search and an evaluation of the amplitudes of harmonics using a detected pitch derived from a shape of the spectrum from one band to another by minimizing an evaluation error of the amplitudes of harmonics over each of the predetermined plurality of frequency bands, wherein the shape of the spectrum has a structure of the harmonics and wherein a high-precision pitch search comprised of a first pitch search carried out based on a rough pitch detected by a rough pitch search and a second pitch search of higher precision than the first pitch search is carried out in the step of simultaneously carrying out a pitch search and an evaluation of the amplitudes of harmonics.

6. The signal encoding method as claimed in claim 5 wherein the first pitch search is carried out for the entire frequency spectrum and wherein the second pitch search is independently performed in each of a high frequency range side and a low frequency range side of the frequency spectrum.

7. A speech encoding apparatus in which a speech signal is divided on a time axis in terms of a pre-set encoding unit and a pitch equivalent to a basic period of the speech signal thus divided into the encoding units is detected, and in which the speech signal is analyzed from one encoding unit to another based on the detected pitch, comprising:

means for splitting the frequency spectrum of the speech signal into a predetermined plurality of frequency bands on the frequency axis; and means for simultaneously carrying out a pitch search and an evaluation of the amplitudes of harmonics using the pitch derived from the spectral shape from one band to another by minimizing an evaluation error of the amplitudes of harmonics over each of the predetermined plurality of frequency bands, wherein a shape of the spectrum has a structure of the harmonics and wherein said means for simultaneously carrying out a pitch search and an evaluation of the amplitudes of harmonics includes means for carrying out a high-precision pitch search comprised of a first pitch search carried out based on a rough pitch detected by a rough pitch search and a second pitch search of higher precision than the first pitch search.

8. The signal encoding apparatus as claimed in claim 7 wherein the first pitch search is carried out for the entire frequency spectrum and wherein the second pitch search is independently performed in each of a high frequency range side and a low frequency range side of the frequency spectrum.

9. The speech analysis method as claimed in claim 1, further comprising the step of selecting a pitch output from a result of the pitch search over the predetermined plurality of frequency bands.

10. The speech analysis method as claimed in claim 3, further comprising the step of determining a pitch output as a difference between a pitch of the high frequency range side and a pitch of the low frequency range side.

11. The encoding method as claimed in claim 5, further comprising the step of selecting a pitch output from a result of the pitch search over the predetermined plurality of frequency bands.

12. The encoding method as claimed in claim 6, further comprising the step of determining a pitch output as a difference between a pitch of the high frequency range side and a pitch of the low frequency range side.

13. The speech encoding apparatus as claimed in claim 7, wherein a pitch outputted by the means for simultaneously carrying out a pitch search is selected from a result of the pitch search over the predetermined plurality of frequency bands.

14. The speech encoding apparatus as claimed in claim 8, wherein a pitch outputted by the means for simultaneously carrying out a pitch search is a difference between a pitch of the high frequency range side and a pitch of the low frequency range side.

* * * * *